US006780146B2

(12) United States Patent
Thomas et al.

(10) Patent No.: US 6,780,146 B2
(45) Date of Patent: Aug. 24, 2004

(54) METHODS FOR APPLYING SLIDERS TO RECLOSABLE PLASTIC BAGS

(75) Inventors: Toby R. Thomas, Victor, NY (US); Nathan A. Kolovich, Rochester, NY (US); Craig E. Cappel, Pittsford, NY (US); Timothy W. Pistner, Fairport, NY (US); Alexander R. Provan, Canandaigua, NY (US)

(73) Assignee: Pactiv Corporation, Lake Forest, IL (US)

( * ) Notice: Subject to any disclaimer, the term of this patent is extended or adjusted under 35 U.S.C. 154(b) by 25 days.

(21) Appl. No.: 10/245,080

(22) Filed: Sep. 17, 2002

(65) Prior Publication Data

US 2004/0050017 A1 Mar. 18, 2004

(51) Int. Cl.[7] ..... B31B 1/90; B65B 61/18; B65D 33/16

(52) U.S. Cl. ..... 493/213; 493/394; 493/927; 53/412; 53/133.4; 373/64

(58) Field of Search ..... 53/412, 133.4, 53/139.2; 493/213, 214, 927, 114.394; 156/66, 250; 383/63, 64; 29/408, 409, 410, 767, 768, 766, 769

(56) References Cited

U.S. PATENT DOCUMENTS

| | | | |
|---|---|---|---|
| 2,091,617 | A | 5/1937 | Sundback |
| 3,225,429 | A | 12/1965 | Fady |
| 3,381,592 | A | 5/1968 | Ravel |
| 3,416,396 | A | 12/1968 | Donner |
| 3,473,589 | A | 10/1969 | Gotz |
| 3,532,571 | A | 10/1970 | Ausnit |
| RE27,174 | E | 9/1971 | Ausnit |
| 3,608,439 | A | 9/1971 | Ausnit |
| 3,613,524 | A | 10/1971 | Behr et al. |

(List continued on next page.)

FOREIGN PATENT DOCUMENTS

| | | |
|---|---|---|
| EP | 0 939 034 A1 | 9/1999 |
| EP | 0 978 450 A1 | 2/2000 |
| EP | 1 026 077 A2 | 8/2000 |
| GB | 2 085 519 A | 4/1982 |
| GB | 2 085 519 | 4/1982 |
| WO | WO 95/29604 | 11/1995 |
| WO | WO 95/35046 | 12/1995 |
| WO | WO 95/35047 | 12/1995 |
| WO | WO 95/35048 | 12/1995 |
| WO | 99/24325 | 5/1999 |

(List continued on next page.)

*Primary Examiner*—Rinaldi I. Rada
*Assistant Examiner*—Paul Durand
(74) *Attorney, Agent, or Firm*—Jenkens & Gilchrist

(57) ABSTRACT

Methods are provided for making slider-operated fasteners for use in reclosable plastic bags using at least a double index and dual unit operations. The methods involve forming two preseals, forming two notches within the preseals, applying two sliders into the previously formed notches, and applying two end stops proximate the previously applied sliders by having the various stations perform their respective functions, either simultaneously or at generally the same time, on different parts of the fastener spaced approximately at a double index. Also provided are methods of producing finished bags by applying the slider-operated fastener to a flat web of plastic film and conveying the web to a vertical or a horizontal form-fill-seal machine.

37 Claims, 11 Drawing Sheets

U.S. PATENT DOCUMENTS

Figure 1:
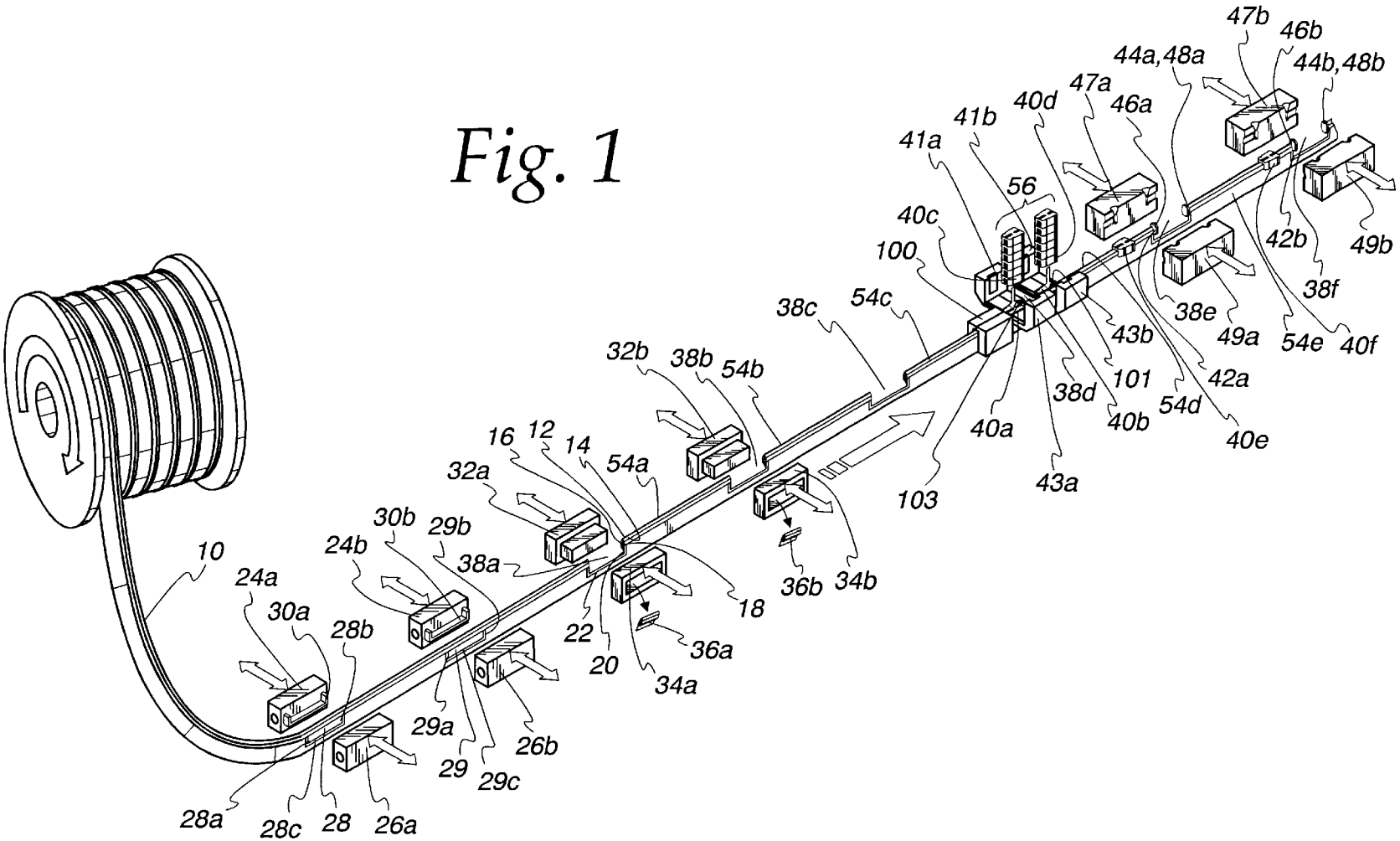

| | | | |
|---|---|---|---|
| 3,701,191 | A | 10/1972 | Laguerrre |
| 3,701,192 | A | 10/1972 | Laguerre |
| 3,713,923 | A | 1/1973 | LaGuerre |
| 3,785,111 | A | 1/1974 | Pike |
| 3,839,128 | A | 10/1974 | Arai |
| 3,948,705 | A | 4/1976 | Ausnit |
| 3,962,007 | A | 6/1976 | Heimberger |
| 4,094,729 | A | 6/1978 | Boccia |
| 4,196,030 | A | 4/1980 | Ausnit |
| 4,240,241 | A | 12/1980 | Sanborn, Jr. |
| 4,246,288 | A | 1/1981 | Sanborn, Jr. |
| 4,277,241 | A | 7/1981 | Schulze |
| 4,309,233 | A | 1/1982 | Akashi |
| 4,341,575 | A | 7/1982 | Herz |
| 4,355,494 | A | 10/1982 | Tilman |
| 4,372,793 | A | 2/1983 | Herz |
| 4,415,386 | A | 11/1983 | Ferrell et al. |
| 4,430,070 | A | 2/1984 | Ausnit |
| 4,437,293 | A | 3/1984 | Sanborn, Jr. |
| 4,517,788 | A | 5/1985 | Scheffers |
| 4,528,224 | A | 7/1985 | Ausnit |
| 4,563,319 | A | 1/1986 | Ausnit et al. |
| 4,581,006 | A | 4/1986 | Hugues et al. |
| 4,582,549 | A | 4/1986 | Ferrell |
| 4,601,694 | A | 7/1986 | Ausnit |
| 4,615,083 | A | 10/1986 | Mayerhofer |
| 4,617,683 | A | 10/1986 | Christoff |
| 4,651,504 | A | 3/1987 | Bentsen |
| 4,655,862 | A | 4/1987 | Christoff et al. |
| 4,663,915 | A | 5/1987 | Van Erden et al. |
| 4,666,536 | A | 5/1987 | Van Erden et al. |
| 4,673,383 | A | 6/1987 | Bentsen |
| 4,691,372 | A | 9/1987 | Van Erden |
| 4,703,518 | A | 10/1987 | Ausnit |
| 4,709,398 | A | 11/1987 | Ausnit |
| 4,709,533 | A | 12/1987 | Ausnit |
| 4,710,157 | A | 12/1987 | Posey |
| 4,782,951 | A | 11/1988 | Griesbach et al. |
| 4,787,880 | A | 11/1988 | Ausnit |
| 4,790,126 | A | 12/1988 | Boeckmann |
| 4,807,300 | A | 2/1989 | Ausnit et al. |
| 4,812,074 | A | 3/1989 | Ausnit et al. |
| 4,820,178 | A | 4/1989 | Anderson et al. |
| 4,840,012 | A | 6/1989 | Boeckmann |
| 4,840,611 | A | 6/1989 | Van Erden et al. |
| 4,844,759 | A | 7/1989 | Boeckmann |
| 4,876,842 | A | 10/1989 | Ausnit |
| 4,878,987 | A | 11/1989 | Ven Erden |
| 4,892,414 | A | 1/1990 | Ausnit |
| 4,892,512 | A | 1/1990 | Branson |
| 4,894,975 | A | 1/1990 | Ausnit |
| 4,909,017 | A | 3/1990 | McMahon et al. |
| 4,924,655 | A | 5/1990 | Posey |
| 4,925,318 | A | 5/1990 | Sorensen |
| 4,929,225 | A | 5/1990 | Ausnit et al. |
| 4,941,307 | A | 7/1990 | Wojcik |
| 4,969,309 | A | 11/1990 | Schwarz et al. |
| 4,974,395 | A | 12/1990 | McMahon |
| 4,993,212 | A | 2/1991 | Veoukas |
| 5,005,707 | A | 4/1991 | Hustad et al. |
| 5,007,142 | A | 4/1991 | Herrington |
| 5,007,143 | A | 4/1991 | Herrington |
| 5,010,627 | A | 4/1991 | Herrington et al. |
| 5,014,498 | A | 5/1991 | McMahon |
| 5,027,584 | A | 7/1991 | McMahon et al. |
| 5,036,643 | A | 8/1991 | Bodolay |
| 5,042,224 | A | 8/1991 | McMahon |
| 5,046,300 | A | 9/1991 | Custer et al. |
| 5,063,639 | A | 11/1991 | Boeckmann et al. |
| 5,067,208 | A | 11/1991 | Herrington, Jr. |
| 5,072,571 | A | 12/1991 | Boeckmann |
| 5,085,031 | A | 2/1992 | McDonald |
| 5,088,971 | A | 2/1992 | Herrington |
| 5,092,831 | A | 3/1992 | James et al. |
| 5,096,516 | A | 3/1992 | McDonald et al. |
| 5,105,603 | A | 4/1992 | Natterer |
| 5,107,658 | A | 4/1992 | Hustad et al. |
| 5,111,643 | A | 5/1992 | Hobock |
| 5,116,301 | A | 5/1992 | Robinson et al. |
| 5,127,208 | A | 7/1992 | Custer et al. |
| 5,131,121 | A | 7/1992 | Herrington, Jr. |
| 5,147,272 | A | 9/1992 | Richison et al. |
| 5,152,613 | A | 10/1992 | Herrington, Jr. |
| 5,161,286 | A | 11/1992 | Herrington, Jr. |
| 5,179,816 | A | 1/1993 | Wojnicki |
| 5,188,461 | A | 2/1993 | Sorensen |
| 5,211,482 | A | 5/1993 | Tilman |
| 5,247,781 | A | 9/1993 | Runge |
| 5,254,073 | A | 10/1993 | Richison et al. |
| 5,259,904 | A | 11/1993 | Ausnit |
| 5,273,511 | A | 12/1993 | Boeckman |
| 5,274,852 | A | 1/1994 | Hogan |
| 5,301,395 | A | 4/1994 | Richardson et al. |
| 5,322,579 | A | 6/1994 | Van Erden |
| 5,334,127 | A | 8/1994 | Bruno et al. |
| 5,383,989 | A | 1/1995 | McMahon |
| 5,400,565 | A | 3/1995 | Terminella et al. |
| 5,400,568 | A | 3/1995 | Kanemitsu et al. |
| 5,405,478 | A | 4/1995 | Richardson et al. |
| 5,405,629 | A | 4/1995 | Marnocha et al. |
| 5,412,924 | A | 5/1995 | Ausnit |
| 5,415,904 | A | 5/1995 | Takubo et al. |
| 5,425,216 | A | 6/1995 | Ausnit |
| 5,425,825 | A | 6/1995 | Rasko et al. |
| 5,426,830 | A | 6/1995 | Richardson et al. |
| 5,431,760 | A | 7/1995 | Donovan |
| 5,435,864 | A | 7/1995 | Machacek et al. |
| 5,442,837 | A | 8/1995 | Morgan |
| 5,442,838 | A | 8/1995 | Richardson et al. |
| 5,448,807 | A | 9/1995 | Herrington, Jr. |
| 5,448,808 | A | 9/1995 | Gross |
| 5,470,156 | A | 11/1995 | May |
| 5,482,375 | A | 1/1996 | Richardson et al. |
| 5,489,252 | A | 2/1996 | May |
| 5,492,411 | A | 2/1996 | May |
| 5,505,037 | A | 4/1996 | Terminella et al. |
| 5,509,735 | A | 4/1996 | May |
| 5,511,884 | A | 4/1996 | Bruno et al. |
| 5,519,982 | A | 5/1996 | Herber et al. |
| 5,525,363 | A | 6/1996 | Herber et al. |
| 5,542,902 | A | 8/1996 | Richison et al. |
| 5,551,127 | A | 9/1996 | May |
| 5,551,208 | A | 9/1996 | Van Erden |
| 5,557,907 | A | 9/1996 | Malin et al. |
| 5,558,613 | A | 9/1996 | Tilman et al. |
| 5,561,966 | A | 10/1996 | English |
| 5,564,259 | A | 10/1996 | Stolmeier |
| 5,573,614 | A | 11/1996 | Tilman et al. |
| 5,592,802 | A | 1/1997 | Malin et al. |
| 5,603,123 | A | 2/1997 | Chupa |
| 5,613,934 | A | 3/1997 | May |
| 5,628,566 | A | 5/1997 | Schreiter |
| 5,647,671 | A | 7/1997 | May |
| 5,661,852 | A | 9/1997 | Kessler |
| 5,669,715 | A | 9/1997 | Dobreski et al. |
| 5,682,730 | A | 11/1997 | Dobreski |
| 5,694,646 | A | 12/1997 | Roberts |
| 5,722,128 | A | 3/1998 | Toney et al. |
| 5,725,312 | A | 3/1998 | May |
| 5,775,812 | A * | 7/1998 | St. Phillips et al. ..... 383/5 |
| 5,782,733 | A | 7/1998 | Yeager |

5,788,378 A 8/1998 Thomas
5,823,933 A 10/1998 Yeager
5,833,791 A 11/1998 Bryniarski et al.
5,851,070 A * 12/1998 Dobreski et al. ..... 383/63
5,867,875 A 2/1999 Beck et al.
5,896,627 A 4/1999 Cappel et al.
5,906,438 A 5/1999 Laudenberg
5,956,924 A 9/1999 Thieman
5,964,532 A 10/1999 St. Phillips et al.
6,044,621 A 4/2000 Malin et al.
6,135,636 A * 10/2000 Randall ..... 383/64
6,138,436 A 10/2000 Malin et al.
6,138,439 A 10/2000 McMahon et al.
6,161,271 A 12/2000 Schreiter
6,178,722 B1 1/2001 McMahon
6,199,256 B1 * 3/2001 Revnew et al. ..... 29/408
6,244,021 B1 * 6/2001 Ausnit et al. ..... 53/412
6,286,189 B1 9/2001 Provan et al.
6,289,561 B1 9/2001 Provan et al.
6,292,986 B1 9/2001 Provan et al.
6,347,437 B2 2/2002 Provan et al.
6,360,513 B1 3/2002 Strand et al.
6,364,530 B1 * 4/2002 Buchman ..... 383/64
6,376,035 B1 * 4/2002 Dobreski et al. ..... 428/35.2
6,418,605 B1 * 7/2002 Kettner ..... 29/408
6,419,391 B2 7/2002 Thomas
6,427,421 B1 * 8/2002 Belmont et al. ..... 53/412
6,470,551 B1 10/2002 Provan et al.
6,494,018 B1 12/2002 Vanderlee et al.
6,508,969 B1 1/2003 Kolovich et al.
6,517,242 B1 * 2/2003 Buchman ..... 383/5
6,517,473 B1 2/2003 Cappel
6,526,632 B1 3/2003 Blythe et al.
6,526,726 B1 3/2003 Strand et al.
6,581,358 B2 * 6/2003 Buchman ..... 53/412
6,611,996 B2 * 9/2003 Blythe et al. ..... 24/399
6,622,353 B2 * 9/2003 Provan et al. ..... 24/585.12

* cited by examiner

METHODS FOR APPLYING SLIDERS TO RECLOSABLE PLASTIC BAGS

FIELD OF THE INVENTION

This invention generally relates to reclosable plastic bags, and more particularly, to methods of applying sliders to a fastener-carrying plastic web and methods of making reclosable plastic bags by using a pre-applied slider-operated fastener.

BACKGROUND OF THE INVENTION

In one method of making slider-operated reclosable bags, a single bag is made per film index. For example, by drawing five inches of film per index from a fastener-carrying web of film, each unit operation performs a task at locations spaced at five inch increments and a five inch wide bag can be made. In this method, a single preseal forming station, notch forming station, slider inserter station, and end termination forming station are located at five inch increments.

One way to increase the number of bags which can be produced per index is to use a double index and dual unit operations. In other words, rather than drawing five inches of film per index from the fastener-carrying web to make a five inch wide bag, ten inches of film are drawn per index from the fastener-carrying web. By using dual unit operations which are spaced at five inch increments and a double index draw, two five inch wide bags can be made per index rather than a single five inch wide bag per index.

A problem in using a double index draw and dual unit operations to make slider-operated reclosable bags involves interference from the trailing slider. In a typical operation, a guiding mechanism is used to guide the track and insert the slider onto the track as it indexes forward. Where a dual slider inserter step is used in conjunction with a double index, two sliders are inserted onto the track. However, as the film indexes forward, the trailing slider interferes with the guiding mechanism, making this method impracticable.

Hence, there exists a need for methods of applying sliders to fasteners for reclosable bags and methods of making slider-operated reclosable bags using a double index draw and dual unit operations that overcome the problems associated with interference from the trailing slider.

SUMMARY OF THE INVENTION

To overcome the aforementioned shortcomings, the present invention provides methods of making slider-operated reclosable bags using at least a double index and dual unit operations which eliminate interference from the trailing slider. The present invention also provides methods of applying one or more sliders to a fastener-carrying web of plastic film using at least a double index and dual unit operations which eliminate interference from the trailing slider.

According to one embodiment, the invention relates to a method of applying at least two sliders onto a fastener. A fastener is provided which includes first and second opposing tracks having respective first and second interlocking profiles and respective first and second fins which extend from the respective first and second profiles. At least first and second notches are formed into the tracks and fins. The first notch is located downstream from the second notch. The first and second notches assist in defining a first segment and a second segment. The first segment is located upstream from and adjacent to the second notch, and the second segment is located between the first and second notches. First and second sliders are fed into the first notch, where the first slider is located upstream from the second slider. The first slider is applied onto the second segment of the tracks as the fastener indexes forward, the tracks are closed, and the second slider is applied onto the second segment of the tracks as the fastener indexes forward. As the fastener indexes forward, the second slider is released to travel with and remain on the second segment. As the fastener indexes forward, the first slider is passed through the second notch, is applied onto the first segment, and is released to travel with and remain on the first segment of the tracks. The fastener may be applied to a web of plastic film.

The invention further relates to a method of making reclosable plastic bags. A web of plastic film is provided. A fastener is provided which includes first and second opposing tracks having respective first and second interlocking profiles and respective first and second fins which extend from the respective first and second profiles. The first and second fins are sealed to each other. At least first and second notches are formed into the tracks and fins. The first notch is located downstream from the second notch. The first and second notches assist in defining a first segment and a second segment. The first segment is located upstream from and adjacent to the second notch, and the second segment is located between the first and second notches. First and second sliders are fed into the first notch, where the first slider is located upstream from the second slider. The first slider is applied onto the second segment of the tracks as the fastener indexes forward, the tracks are closed, and the second slider is applied onto the second segment of the tracks as the fastener indexes forward. As the fastener indexes forward, the second slider is released to travel with and remain on the second segment. As the fastener indexes forward, the first slider is passed through the second notch and is applied onto the first segment of the tracks. The fastener is conveyed to an end stop applicator where at least a first end stop is formed on the first segment and at least a second end stop is formed on the second segment. The fastener is applied to a web of plastic film, and the web is formed into a plurality of interconnected plastic bags.

According to another embodiment, the invention relates to a method of applying at least two sliders onto a fastener. A fastener is provided which includes first and second opposing tracks having respective first and second interlocking profiles and respective first and second fins which extend from the respective first and second profiles. At least first and second openings are formed into the tracks and fins. The first opening is located downstream from the second opening. The first and second openings assist in defining a first segment and a second segment. The first segment is located upstream from and adjacent to the second opening, and the second segment is located between the first and second openings. The second segment is moved into a different plane from a plane of the first segment. At generally the same, the first slider is fed into the first opening and the second slider is fed into the second opening. As the fastener indexes forward and at generally the same time, the first slider is applied onto the second segment of the tracks and the second slider is applied onto the first segment of the tracks. The fastener may be applied to a web of plastic film.

The invention further relates to a method of making reclosable plastic bags. A web of plastic film is provided. A fastener is provided which includes first and second opposing tracks having respective first and second interlocking profiles and respective first and second fins which extend from the respective first and second profiles. The first and second fins are sealed to each other. At least first and second openings are formed into the tracks and fins. The first opening is located downstream from the second opening. The first and second openings assist in defining a first segment and a second segment. The first segment is located upstream from and adjacent to the second opening, and the second segment is located between the first and second openings. The second segment is moved into a different plane from a plane of the first segment. At generally the same, the first slider is fed into the first opening and the second slider is fed into the second opening. As the fastener indexes forward and at generally the same time, the first slider is applied onto the second segment of the tracks and the second slider is applied onto the first segment of the tracks. The second segment is moved back into the plane of the first segment. The fastener is conveyed to an end stop applicator where at least a first end stop is formed on the first segment and at least a second end stop is formed on the second segment. The fastener is applied to a web of plastic film, and the web is formed into a plurality of interconnected plastic bags.

According to a still further embodiment, the invention relates to a method of applying at least two sliders onto a fastener. A fastener is provided which includes first and second opposing tracks having respective first and second interlocking profiles and respective first and second fins which extend from the respective first and second profiles. At least first and second notches are formed into the tracks and fins. The first notch is located downstream from the second notch. The first and second notches assist in defining a first segment and a second segment. The first segment is located upstream from and adjacent to the second notch, and the second segment is located between the first and second notches. At generally the same time, the first slider is fed into the first notch and the second slider is fed into the second notch. As the fastener indexes forward and at generally the same time, the first slider is applied onto the second segment and the second slider is applied onto the first segment.

The above summary of the present invention is not intended to represent each embodiment, or every aspect, of the present invention. This is the purpose of the figures and the detailed description which follow.

BRIEF DESCRIPTION OF TILE DRAWINGS

Other objects and advantages of the invention will become apparent upon reading the following detailed description and upon reference to the drawings in which:

FIG. 1 depicts a method of making a slider-operated fastener.

FIGS. 2*a*–2*g* depict an enlarged view of the slider inserter operation shown in FIG. 1.

Figure 3:
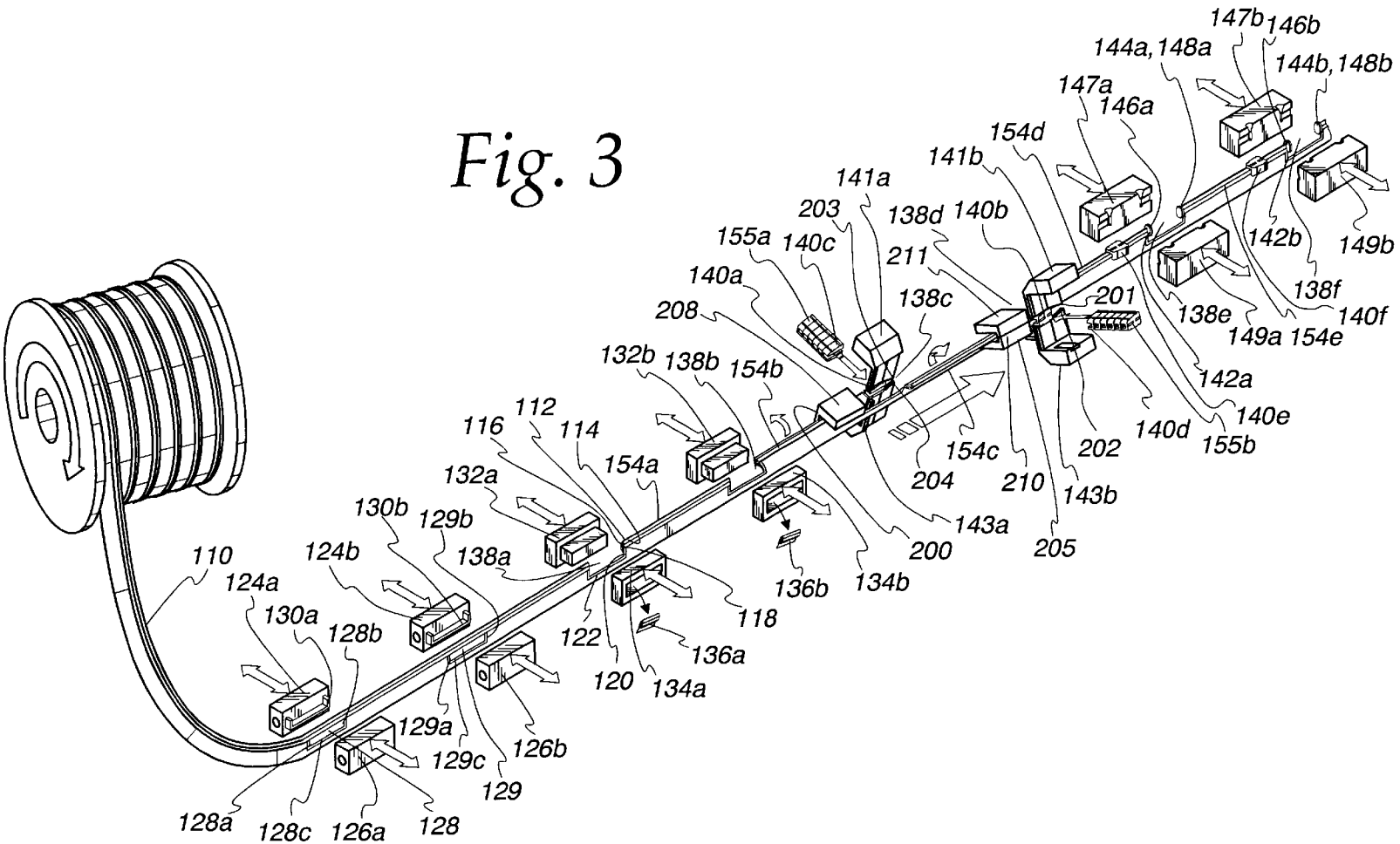

FIG. 3 depicts a method of making a slider-operated fastener according to an alternative embodiment of the invention.

FIGS. 4*a*–4*e* depict an enlarged view of the slider inserter operation shown in FIG. 3.

Figure 5:
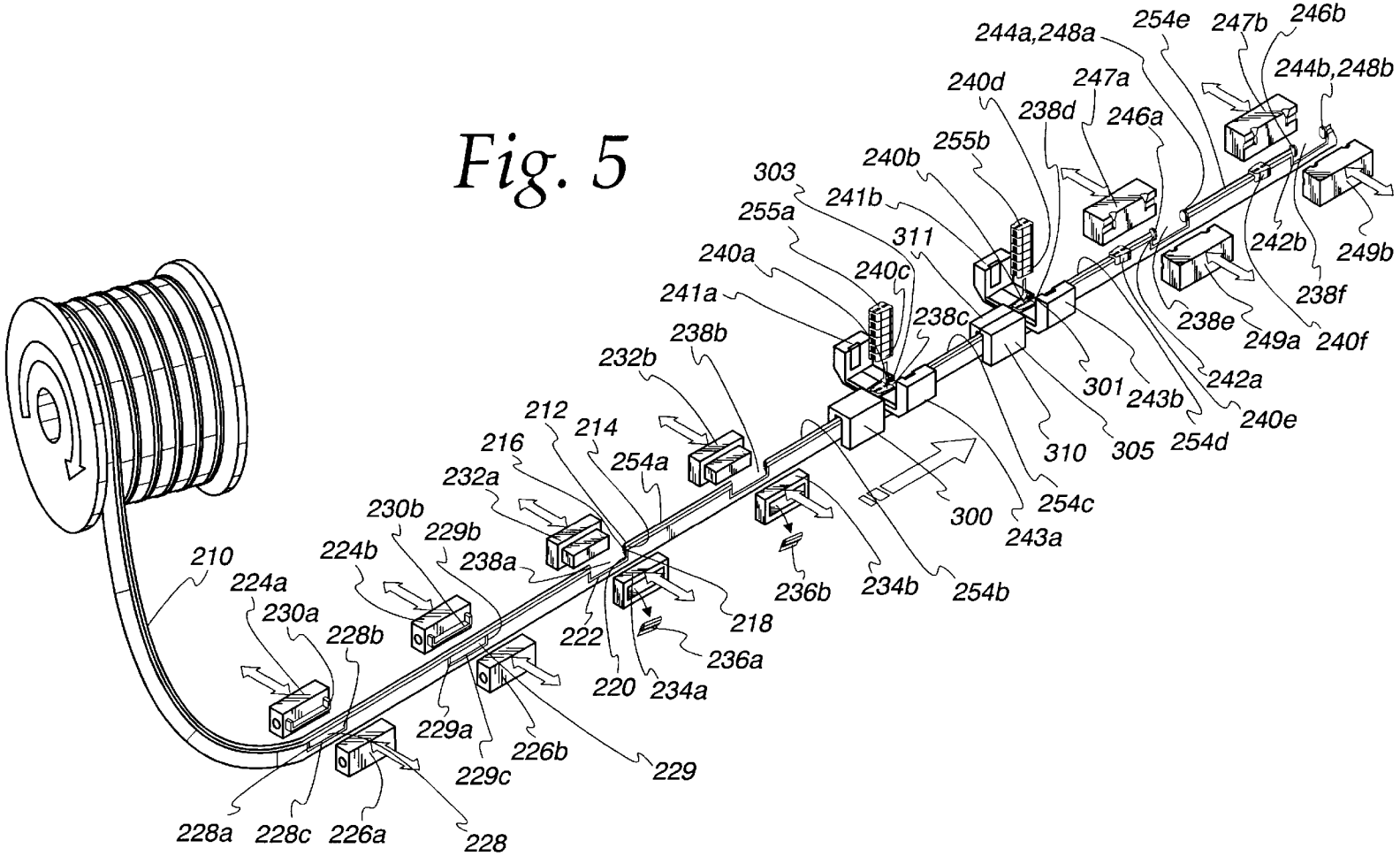

FIG. 5 depicts a method of making a slider-operated fastener according to an additional alternative embodiment of the invention.

FIGS. 6*a*–6*d* depict an enlarged view of the slider inserter operation shown in FIG. 5.

Figure 7:
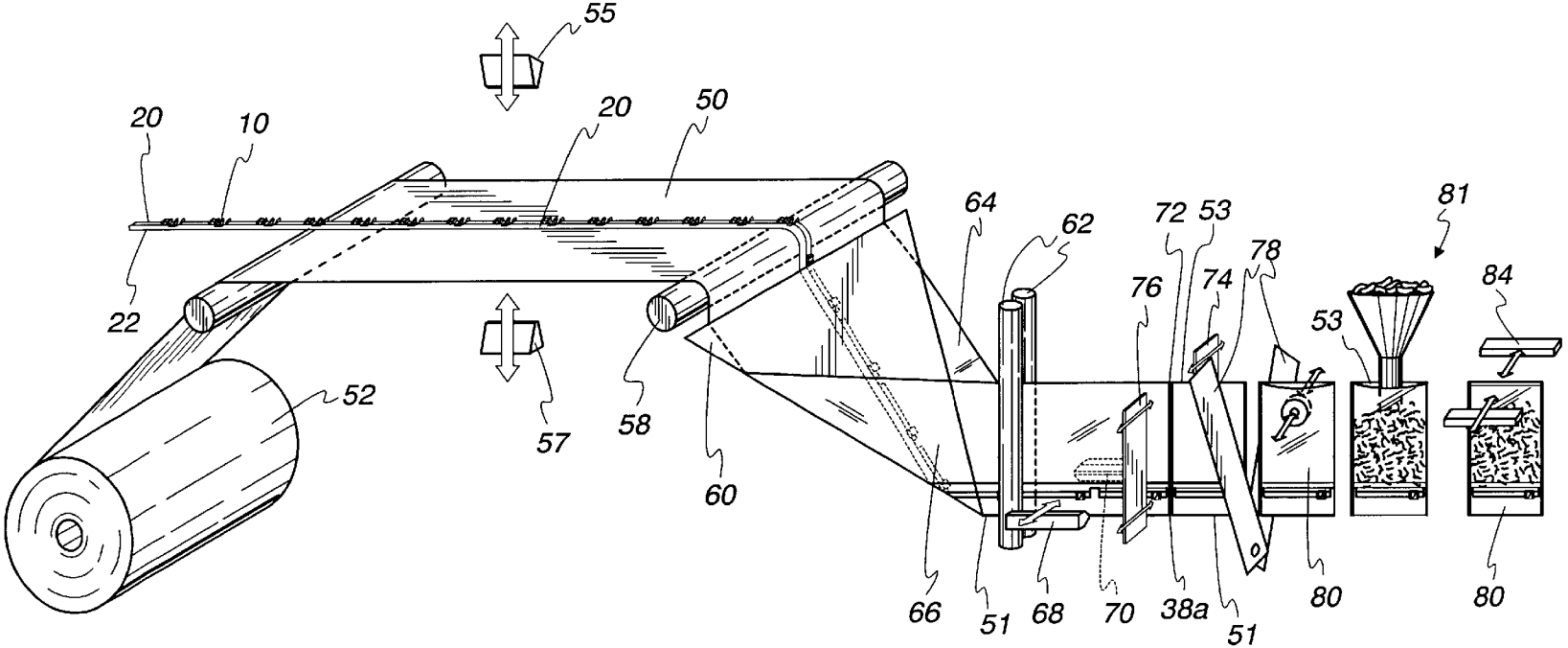

FIG. 7 depicts a method for attaching a slider-operated fastener to a flat web of plastic film and then conveying the web to a horizontal FFS machine.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF EMBODIMENTS OF THE INVENTION

Turning to the drawings, FIGS. 1 and 2*a*–2*g* depict a method of making a slider-operated fastener for use in reclosable plastic bags. In the method, there is provided a continuous fastener 10 including first and second opposing tracks 12, 14. The tracks 12, 14 include respective first and second interlocking profiles 16, 18 and respective first and second fins 20, 22 extending downward from the respective profiles 16, 18. The profile 16 preferably includes a rib, and the profile 18 preferably includes a groove for receiving the rib. Further details concerning the construction of the profiles 16, 18 may be obtained from U.S. Pat. No. 5,007,143 to Herrington, which is incorporated herein by reference in its entirety. The fastener 10 may be unwound from a spool or the like.

The process depicted in FIG. 1 begins by performing a double index draw of fastener 10. For example, for a five inch bag-width, the fastener 10 is drawn ten inches. A double index as used herein is defined as approximately two bag-width distances. The fastener 10 advances two bag-width distances forward by rollers and the like (not shown) to a preseal station. The preseal station includes a first pair of reciprocating seal bars 24*a*, 26*a* and a second pair of reciprocating seal bars 24*b*, 26*b*. Either each seal bar 24*a*, 24*b*, 26*a*, 26*b* moves back and forth between open and closed positions or one of the seal bars in the pair is stationary while the other seal bar moves back and forth. At least the seal bars 24*a*, 24*b* are heated. The other seal bars 26*a*, 26*b* may be heated as well or may simply serve as a backing against which the heated seal bars 24*a*, 24*b* apply pressure when the first pair of reciprocating seal bars 24*a*, 26*a* and the second pair of reciprocating seal bars 24*b*, 26*b*, respectively, are brought together. The temperature, pressure, and dwell time of the first pair of reciprocating seal bars 24*a*, 26*a* and the second pair of reciprocating seal bars 24*b*, 26*b* are properly adjusted to allow the seal bars to impart generally U-shaped preseals 28, 29.

While the fastener 10 is temporarily stopped at the preseal station, the fins 20, 22 are sealed to each other along the generally U-shaped preseals 28, 29. Preseal 28 includes a pair of opposing sides 28*a*, 28*b* and a bottom 28*c* bridging the opposing sides 28*a*, 28*b* while preseal 29 includes a pair of opposing sides 29*a*, 29*b* and a bottom 29*c* bridging the opposing sides 29*a*, 29*b*. The opposing sides 28*a*, 28*b* and 29*a*, 29*b* are generally located along an upper portion of the fins 20, 22 and extend downward from the interlocking profiles 16, 18. The bottoms 28*c*, 29*c* are generally located along a lower portion of the fins 20, 22. The seal bars 24*a*, 24*b* have generally U-shaped projections 30*a*, 30*b* corresponding to the shape of the preseals 28, 29, respectively. Although the preseals 28, 29 are illustrated as being generally U-shaped, the area between the opposing sides 28*a*, 28*b* and 29*a*, 29*b* of the preseals 28, 29, respectively, may be sealed as well so that the preseals 28, 29 appear like solid rectangles. The preseals 28, 29 extend to the bottom of the profiles 16, 18.

After forming the preseals 28, 29, the fastener 10 is double indexed (i.e., conveyed approximately two bag-width distances) forward to a notching station. The notching station includes a first pair of reciprocating cutters 32*a*, 34*a* and a second pair of reciprocating cutters 32*b*, 34*b*. Either each cutter 32*a*, 32*b*, 34*a*, 34*b* moves back and forth between open and closed positions or one of the cutters in the pair is stationary while the other cutter moves back and forth. Cutters 32*a*, 32*b* form rectangular projections while cutters 34*a*, 34*b* form rectangular holes for receiving the respective projection. The fastener 10 is temporarily stopped at the notching station so that the preseals 28, 29 become aligned between the separated pairs of reciprocating cutters 32*a*, 34*a* and 32*b*, 34*b*, respectively. While the fastener 10 is stopped, the pairs of reciprocating cutters 32*a*, 34*a* and 32*b*, 34*b* are brought together such that the rectangular projections of the cutters 32*a*, 32*b* punch rectangular sections 36*a*, 36*b* through the rectangular holes of the cutters 34*a*, 34*b*, thereby leaving generally U-shaped notches 38*a*, 38*b* in the fastener 10. Prior to being punched out, the rectangular sections 36*a*, 36*b* are disposed between the opposing sides 28*a*, 28*b* and 29*a*, 29*b* of the preseals 28, 29 and above the bottoms 28*c*, 29*c* of the preseals 28, 29, respectively. Therefore, the preseals 28, 29 generally encompass the notches 38*a*, 38*b* and define a periphery thereof such that the preseals 28, 29 provide a leak-resistant barrier to entry into an interior of the fastener 10 between the fins 20, 22 via the notches 38*a*, 38*b*. The leak-resistant barrier effectively minimizes leaks in the reclosable plastic bags ultimately formed by the manufacturing process.

The notches 38*a*, 38*b* which are formed at the notching station assist in defining or forming the first and second segments 54*a*, 54*b*, respectively, on the tracks 12, 14 of the fastener 10. The second segment 54*b* of the fastener 10 is located downstream from and adjacent to notch 38*b*. The first segment 54*a* is located upstream from the second segment 54*b* and is located between notch 38*a* and notch 38*b*. Notch 38*b* is sufficiently wide to hold at least two sliders. Although the notching station has been described as being equipped with reciprocating cutters, other cutting devices (not shown) such as rotary cutters may also be used in embodiments of the invention.

After forming the notches 38*a*, 38*b*, the fastener 10 is double indexed forward to a slider inserter station. As shown in FIGS. 1, 2*a*–2*b* and 2*e*–2*g*, the slider inserter station includes a single slider inserter unit 56 which includes at least two adjacent rows of sliders. During the double index of the fastener 10, notch 38*b* becomes aligned with the slider inserter unit 56 and is labeled notch 38*d*. The slider inserter unit 56 remains stationary as the fastener 10 indexes forward. The slider inserter unit 56 may be, for example, a gravity feeder, a power feeder, or a mechanically driven feeder. Examples of mechanically driven feeders include, but are not limited to, belt feeders, drive wheels, surface drives, and walking beams.

Figure 2A:
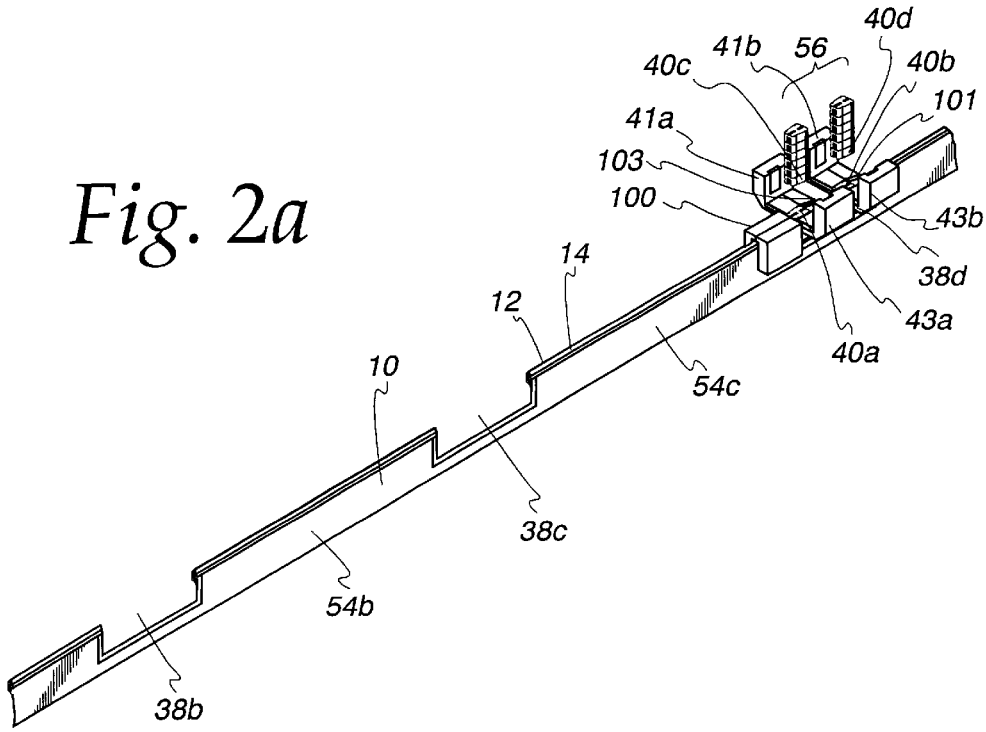
Figure 2B:
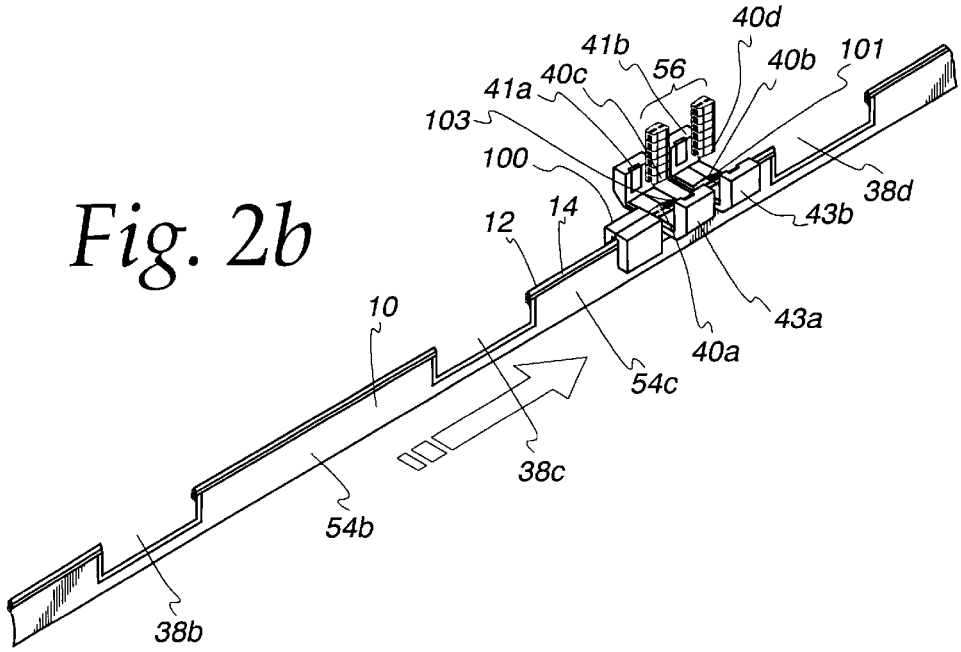
Figure 2C:
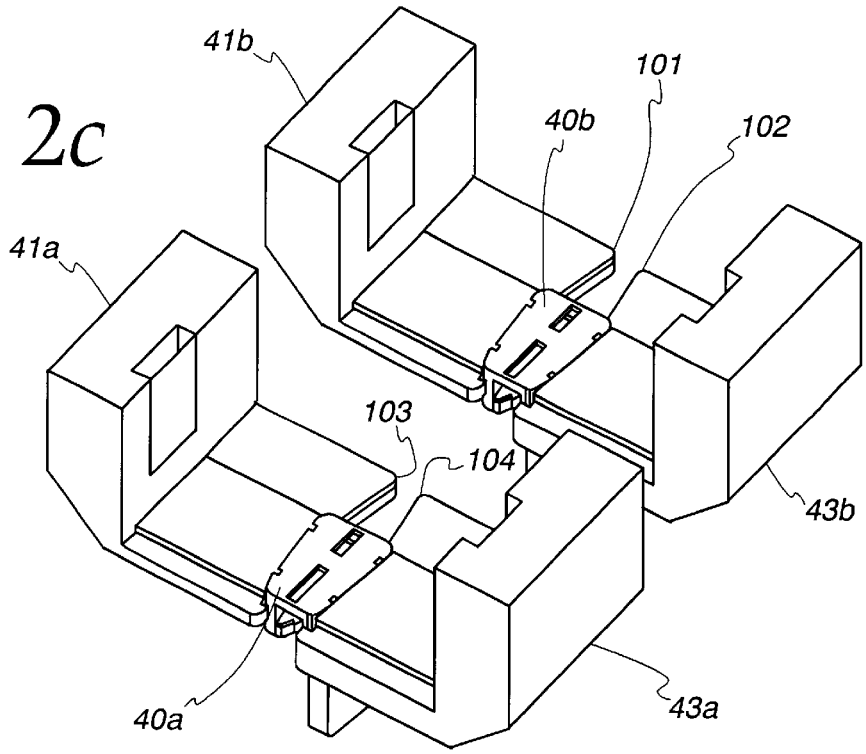
Figure 2D:
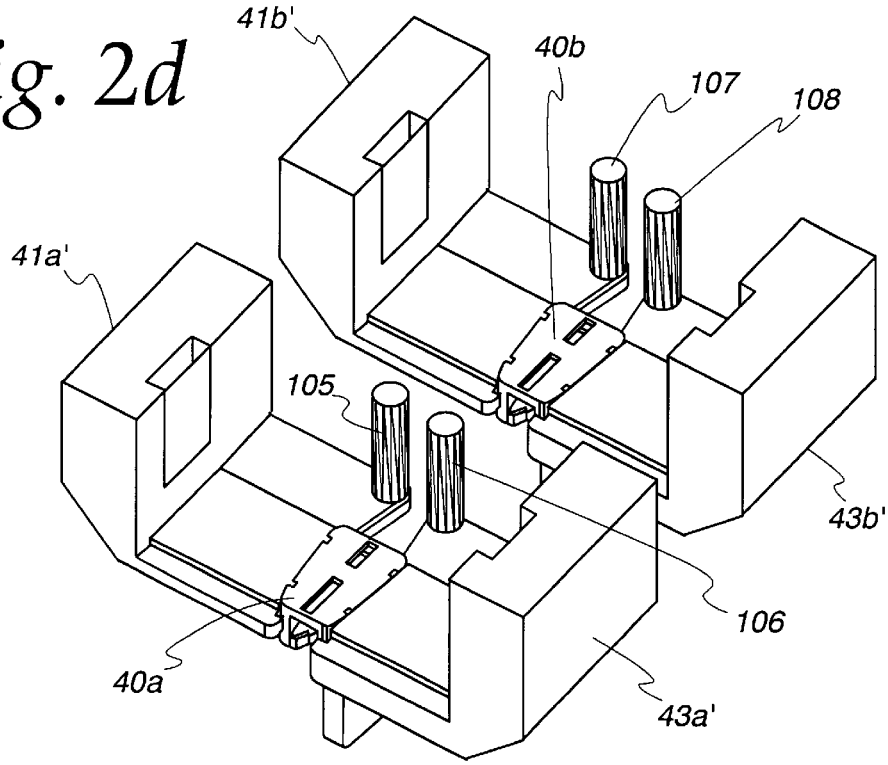

As shown in FIG. 1, the slider inserter station also includes a fastener guide 100 which is located on the third segment 54*c* of the fastener 10 and upstream from the slider inserter unit 56. The fastener guide 100 assists in positioning the fastener 10 for threading a first slider 40*a* and a second slider 40*b* onto the third segment 54*c* of the tracks 12, 14 of the fastener 10. The fastener guide 100 remains positioned upstream from the slider inserter unit 56 during the indexing process. The slider inserter station further includes a first pair of grippers 41*a*, 43*a* and a second pair of grippers 41*b*, 43*b* which assist in holding and positioning the first and second sliders 40*a*, 40*b*, respectively, as the sliders move along the tracks 12, 14. The first and second pair of grippers 41*a*, 43*a* and 41*b*, 43*b* have tapered edges 103, 104 and 101, 102, respectively, as shown in FIGS. 2*c*–2*d*. Both the fastener guide 100 and the first and second pair of grippers 41*a*, 43*a* and 41*b*, 43*b* are in a fixed position and remain stationary as the fastener 10 indexes forward. As discussed below in more detail, as the fastener advances, the tapered edges 103, 104 and 101, 102 of the first and second pair of grippers 41*a*, 43*a* and 41*b*, 43*b*, respectively, close the tracks 12, 14 after being opened when the first and second sliders 40*a*, 40*b* are applied onto the fastener 10. At the slider inserter station, the first slider 40*a* is applied onto the second segment 54*b* of the tracks 12, 14 and the second slider 40*b* is applied onto the third segment 54*c* of the tracks 12, 14 through the process detailed below and shown in FIGS. 1 and 2*a*–2*g*. As shown in FIGS. 1 and 2*a*, the slider inserter unit 56 feeds the first and second sliders 40*a*, 40*b* into the notch 38*d* while the fastener 10 is temporarily stopped (i.e., at dwell). The first pair of grippers 41*a*, 43*a* and the second pair of grippers 41*b*, 43*b* are positioned to allow the first and second sliders 40*a*, 40*b* to be fed unobstructed into the notch 38*d*. The next two sliders 40*c*, 40*d* that are resting in the slider inserter unit 56 are retained in the slider inserter unit 56 until the next double index of the fastener 10. A stop (not shown) such as an escapement or mechanical latch on the slider inserter unit 56 prevents or inhibits sliders 40*c*, 40*d* from feeding into notch 38*d* as the fastener 10 indexes forward during the next double index draw.

As shown in FIGS. 1 and 2*a*, the first pair of grippers 41*a*, 43*a* and the second pair of grippers 41*b*, 43*b* are closed around the first and second sliders 40*a*, 40*b*, respectively, as the slider inserter unit 56 feeds the first and second sliders 40*a*, 40*b* into the notch 38*d*. Alternatively, the first pair of grippers 41*a*, 43*a* and the second pair of grippers 41*b*, 43*b* may be open when the slider inserter unit 56 feeds the first and second sliders 40*a*, 40*b* into the notch 38*d*. In this alternative approach, the first pair of grippers 41*a*, 43*a* and the second pair of grippers 41*b*, 43*b* may subsequently be activated to come in from the side and close around the first and second sliders 40*a*, 40*b*, respectively, while the fastener 10 is at dwell. Once the first and second sliders 40*a*, 40*b* are in position within the notch 38*d*, the fastener 10 begins its double index forward as shown in FIGS. 2*a*–2*b*. Once the fastener 10 begins its double index forward, the fastener 10 does not stop moving until a full double index has been completed. At the beginning of the double index as shown in FIG. 2*a*, notch 38*d* in the fastener 10 is positioned directly below the slider inserter unit 56. As the double index proceeds, notch 38*c* in the fastener 10 which is located upstream from notch 38*d* becomes positioned below the slider inserter unit 56. At the end of a full double index, the successive notch in the fastener (i.e., notch 38*b*) which is located upstream from notches 38*c* and 38*d* becomes positioned below the slider inserter unit 56 as shown in FIG. 2*g*.

The process of applying the first and second sliders 40*a*, 40*b* onto the tracks 12, 14 during the double index of the fastener 10 begins as shown in FIGS. 2*a*–2*b* by applying the first slider 40*a* onto the third segment 54*c* of the tracks 12, 14 followed by applying the second slider 40*b* onto the third segment 54*c* of the tracks 12, 14. As index of the fastener 10 is initiated, the first and second pair of grippers 41*a*, 43*a* and 41*b*, 43*b* remain closed around the first and second sliders 40*a*, 40*b*, respectively, to assist in guiding the first and second sliders 40*a*, 40*b* onto the tracks 12, 14. Specifically, the first pair of grippers 41*a*, 43*a* assist in applying or threading the first slider 40*a* onto the third segment 54*c* of the tracks 12, 14. As shown in FIGS. 2*b*–2*c*, once the first slider 40*a* has been applied onto the third segment 54*c*, the tapered edges 103, 104 on the first pair of grippers 41*a*, 43*a* close the tracks 12, 14 so that the second slider 40*b* can then be applied onto the third segment 54*c* during index of the fastener 10.

Also as shown in FIGS. 2*a*–2*b*, the second pair of grippers 41*b*, 43*b* assist in applying or threading the second slider 40*b* onto the third segment 54*c* of the tracks 12, 14. As shown in FIGS. 2*b*–2*c*, once the second slider 40*b* has been applied onto the third segment 54*c*, the tapered edges 101, 102 on the second pair of grippers 41*b*, 43*b* close the tracks 12, 14. Upon applying the first and second sliders 40*a*, 40*b* onto the third segment 54*c* of the tracks 12, 14, the first and second pair of grippers 41*a*, 43*a* and 41*b*, 43*b* assist in guiding the first and second sliders 40*a*, 40*b*, respectively, along the tracks 12, 14. Using the tapered edges 103, 104 and 101, 102 of the first and second pair of grippers 41*a*, 43*a* and 41*b*, 43*b*, respectively, to close the tracks 12, 14 also makes the subsequent step of forming end stops on the bag ends (described below) easier. Although the step of closing the tracks is shown in FIGS. 2*a*–2*c* using a first and second pair of grippers 41*a*, 43*a* and 41*b*, 43*b* having tapered edges 103, 104 and 101, 102, the step of closing the tracks may also be accomplished by alternative methods including with rollers, pins such as dowell pins, or fingers such as pneumatic, supply, or spring-assisted fingers. For example, FIG. 2*d* shows the first and second pair of grippers 41*a*', 43*a*' and 41*b*', 43*b*' equipped with a first and second pair of roller pins 105, 106 and 107, 108, respectively, for use in closing the tracks upon applying the first and second sliders 40*a*, 40*b* onto the third segment 54*c* of the tracks 12, 14.

Figure 2E:
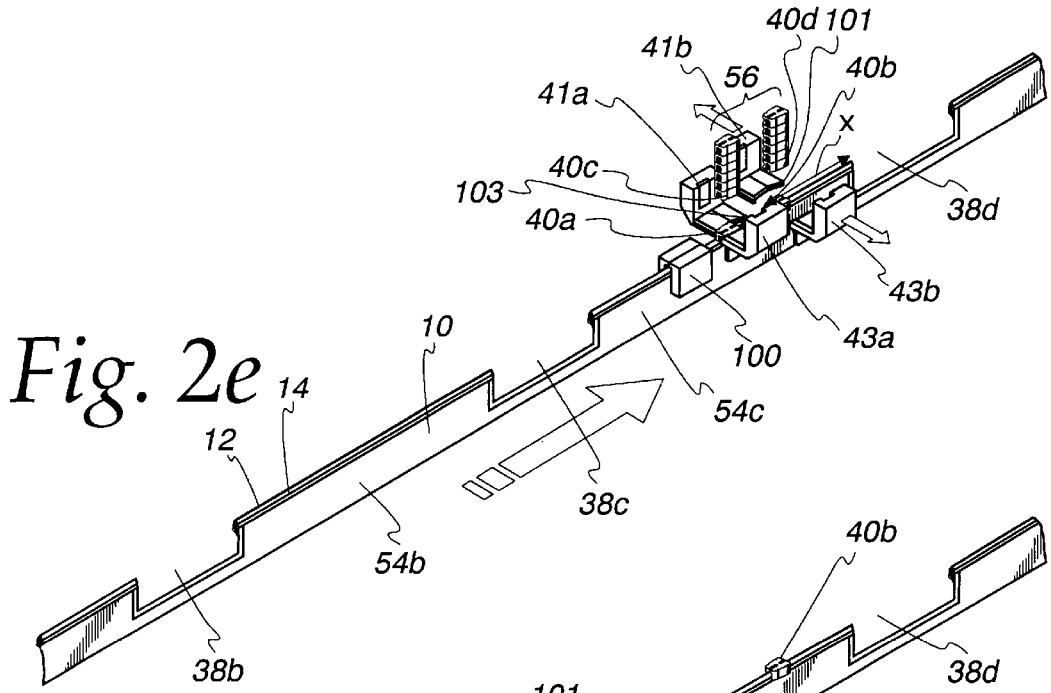
Figure 2F:
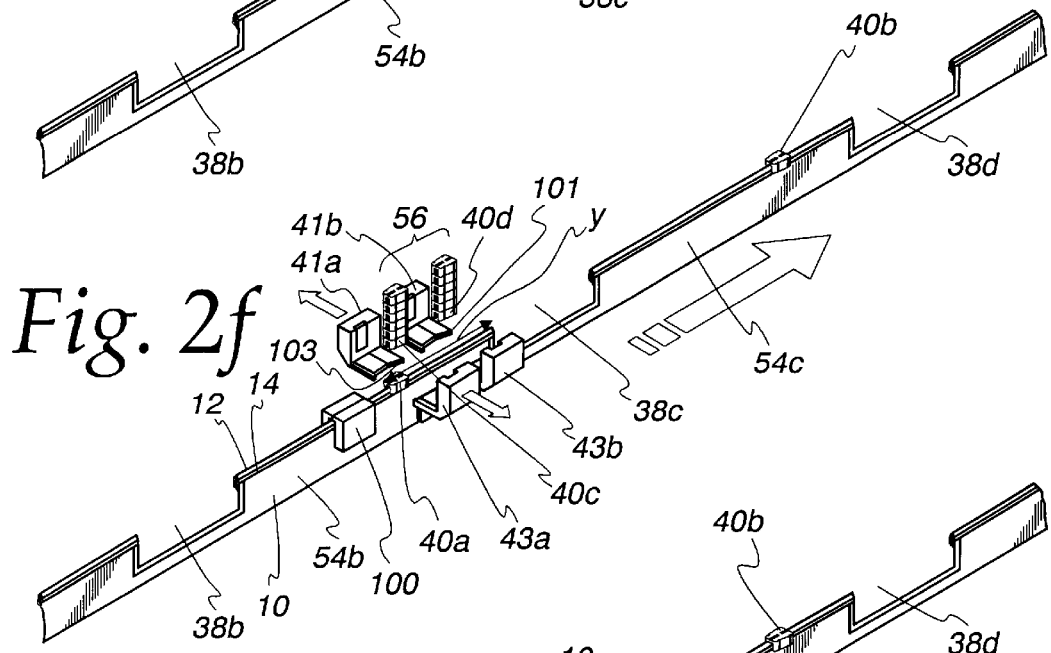
Figure 2G:
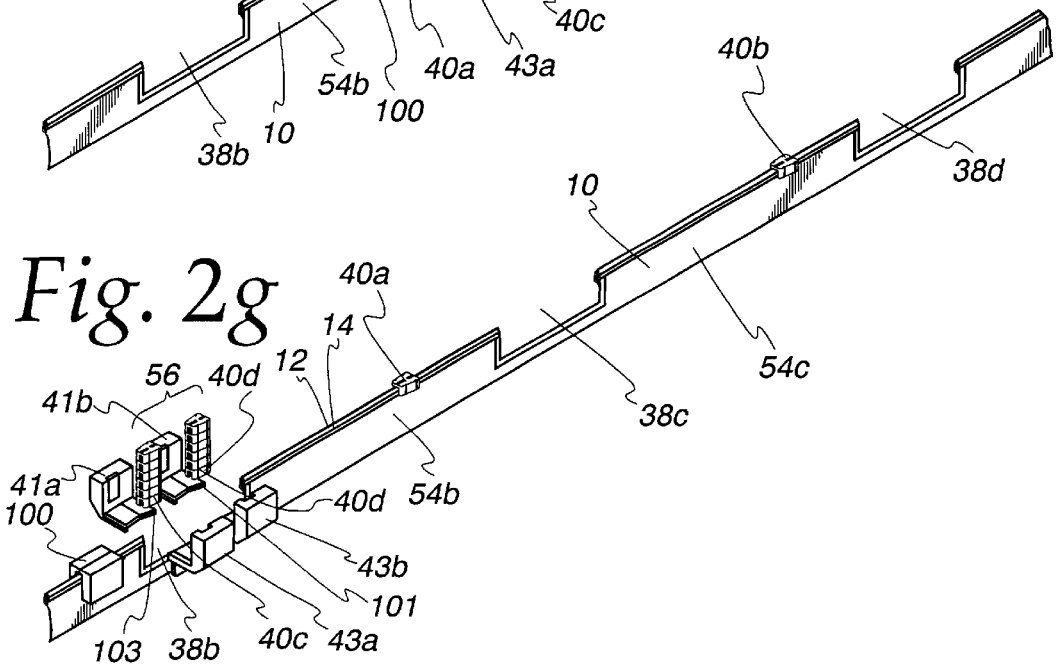

Turning to FIG. 2*e*, the fastener 10 continues its double index. Once the fastener 10 has been indexed a distance x from notch 38*d*, the second pair of grippers 41*b*, 43*b* which are closed around the second slider 40*b* open. By opening the second pair of grippers 41*b*, 43*b*, the second slider 40*b* becomes released to travel with the third segment 54*c* of the tracks 12, 14 during index of the fastener 10. As the fastener 10 continues to index forward, the first slider 40*a* passes through the notch 38*c* and becomes applied or threaded onto the second segment 54*b* of the tracks 12, 14. The first pair of grippers 41*a*, 43*a* remains closed around the first slider 40*a* to assist in guiding the first slider 40*a* through the notch 38*c* and onto the second segment 54*b* of the tracks 12, 14. The second pair of grippers 41*b*, 43*b* remains open so as to avoid interfering with the moving of the first slider 40*a* through the notch 38*c* and the applying of the first slider 40*a* onto the second segment 54*b* of the tracks 12, 14. As shown in FIG. 2*f*, the fastener 10 continues its double index. Once the fastener 10 has been indexed a distance y from notch 38*c*, the first pair of grippers 41*a*, 43*a* which are closed around the first slider 40*a* open. By opening the first pair of grippers 41*a*, 43*a*, the first slider 40*a* becomes released to travel with the second segment 54*b* of the tracks 12, 14 during index of the fastener 10. FIG. 2*g* shows the first slider 40*a* applied on the second segment 54*b* and the second slider 40*b* applied on the third segment 54*c* without the subsequent end stop applicator station components which are described below. FIG. 2*g* also shows the position of the successive notch in the fastener 10, notch 38*b*, below the slider inserter unit 56 upon completion of a full double index FIG. 2*g* further shows the slider inserter unit 56 holding the next two sliders 40*c*, 40*d* at a distance from notch 38*b* upon completion of a complete double index.

Distance x and distance y are set using conventional techniques for indexing fixed distances of flexible material such as, but not limited to, using the motor position on the index, using a set time delay, or using an encoder on the surface of the tracks 12, 14. Using motor position on the index involves, for example, using a servo motor. With every revolution of a servo motor, a fixed distance of track is fed. Each revolution of the servo motor equals a certain number of pulses, and a certain numbers of pulses equals a certain distance of track. For example, if one revolution of the servo motor equals 30,000 pulses and 30,000 pulses equals 10 inches of track, the grippers will open every 15,000 pulses where the value of x is set at 5 inches. With time delay, a distance of track can be equated to a time measurement. For example, if one inch of track is equated to 1/10 sec, the grippers will open at 4/10 sec when the track moves a distance x of 4 inches. With an encoder, a wheel may be fixed to or mounted on the track to feed a certain portion of the track during each revolution of the servo motor. For example, if one revolution of the servo motor equals 30,000 pulses and 30,000 pulses equals 10 inches of track, the grippers will open every 15,000 pulses where the value of x is set at 5 inches. Through the process detailed above and as shown in FIGS. 2*a*–2*g*, the first slider 40*a* is applied onto the second segment 54*b* of the tracks 12, 14 and the second slider 40*b* is applied onto the third segment 54*c* of the tracks 12, 14. In addition, the process detailed above allows the successive notch, notch 38*b*, to become positioned below the slider inserter unit 56 such that the next two sliders 40*c*, 40*d* which are resting in the slider inserter unit 56 are ready to be fed into notch 38*b* when the fastener 10 is temporarily at dwell.

After applying the first and second sliders 40*a*, 40*b* onto the second and third segments 54*b*, 54*c* of the fastener 10, respectively, and completing the double index of the fastener 10, notches 38*c*, 38*d* become positioned at an end stop applicator station. In the embodiment shown in FIG. 1, notch 38*c* becomes positioned between a first pair of chilled, reciprocating molds 47*a*, 49*a* and is labeled notch 38*e*. The second segment 54*b* which contains slider 40*a* (labeled 4*e*) becomes positioned upstream from the first pair of chilled, reciprocating molds 47*a*, 49*a* and notch 38*e* and is labeled 54*d*. Also as shown in FIG. 1, notch 38*d* becomes positioned between a second pair of chilled, reciprocating molds 47*b*, 49*b* and is labeled notch 38*f* The third segment 54*c* which contains slider 40*b* (labeled 40*f*) becomes positioned upstream from the second pair of chilled, reciprocating molds 47*b*, 49*b* and notch 38*f* and is labeled 54*e*.

At the end stop application station, the end stop applicator applies end stops 42*a*, 44*a* and 42*b*, 44*b* to the respective fastener ends 46*a*, 48*a* and 46*b*, 48*b* on opposite sides of the respective notches 38*e*, 38*f*. In the plastic bags ultimately formed by the manufacturing process, end stop 42*a*is located at the fastener end 46*a* of one bag, end stop 44*a* is located at the fastener end 48*a* of the adjacent bag, while end stop 42*b* is located at the fastener end 46*b* of one bag and end stop 44*b* is located at the fastener end 48*b* of the adjacent bag. The end stops perform three primary functions: (1) preventing or inhibiting the sliders from going past the ends of the fasteners, (2) holding the profiles together to resist stresses applied to the profiles during normal use of the plastic bag, and (3) minimizing leakage from inside the plastic bag out through the fastener ends.

The end stop applicator station embodiment shown in FIG. 1 includes a first pair of chilled, reciprocating molds 47*a*, 49*a* and a second pair of chilled, reciprocating molds 47*b*, 49*b*. Either each mold 47*a*, 47*b*, 49*a*, 49*b* moves back and forth between open and closed positions, or one of the molds in the pair is stationary while the other mold moves back and forth. While the fastener 10 is temporarily stopped, the first and second pair of molds 47*a*, 49*a* and 47*b*, 49*b* close around the respective fastener ends 46*a*, 48*a* and 46*b*, 48*b*. A predetermined amount of flowable plastic material is then forced around and between the profiles 16, 18 at the respective fastener ends 46*a*, 48*a* and 46*b*, 48*b* by a conventional back pressure device (not shown) coupled to a supply tube. The first and second pair of molds 47*a*, 49*a* and 47*b*, 49*b* form channels for receiving the plastic material and guiding the plastic material to the respective fastener ends 46*a*, 48*a* and 46*b*, 48*b*. Further details concerning the injection-molded end stops 42*a*, 42*b*, 44*a*, 44*b* and the method of making the same may be obtained from U.S. patent application Ser. No. 09/636,244 entitled "Injection-Molded End Stop for a Slider-Operated Fastener" which is herein incorporated by reference.

Instead of applying injection-molded end stops, other types of end stops may be applied to the fastener ends 46*a*, 46*b*, 48*a*, 48*b* including those disclosed in U.S. Pat. Nos. 5,924,173, 5,833,791, 5,482,375, 5,448,807, 5,442,837, 5,405,478, 5,161,286, 5,131,121, 5,088,971, and 5,067,208. In U.S. Pat. No. 5,067,208, for example, each end stop is in the form of a fairly rigid strap/clip that wraps over the top of the fastener. One end of the strap is provided with a rivet-like member that penetrates through the fastener fins and into a cooperating opening at the other end of the strap.

While the fastener 10 is temporarily stopped during the dwell phase of the cycle in the method depicted in FIGS. 1 and 2*a*–2*g*, the various stations perform their respective functions on different parts of the continuous fastener 10 spaced apart at approximately at a double index (i.e., approximately two bag-width distances apart) either simultaneously or at generally the same time. Therefore, as (1) the preseal station forms new preseals 28, 29; (2) the notching station forms new notches 38*a*, 38*b* within the previously formed preseals 28, 29, (3) the slider insertion station applies sliders 40*a*, 40*b* into notch 38*d*; and (4) the end stop applicator applies end stops 42*a*, 44*a* and 42*b*, 44*b* proximate the previously applied sliders at approximately the same time. Dwell is accomplished using intermittent index, web shuttle, or by the relative motion of equipment to the fastener.

After each of the stations has completed its respective function on the temporarily stopped fastener 10, movement of the fastener 10 resumes. The fastener 10 moves approximately two bag-width distances forward so that the next station can perform its respective function. The preseals 28, 29 are advantageous because they allow the fastener 10 to be controlled during such downstream operations as notch formation, slider application, and end stop application and when the fastener 10 is tensioned by various rollers in the bag-making machine. The preseals 28, 29 keep the interlocking profiles 16, 18 together and prevent or inhibit them from moving longitudinally relative to each other.

While the process described above is directed to a process of forming two preseals, forming two notches within the preseals, applying two sliders into the previously formed notches, and applying two end stops proximate the previously applied sliders by having the various stations perform their respective functions on different parts of the continuous fastener 10 spaced approximately at a double index either simultaneously or at generally the same time, it is contemplated that the process may be modified. For example, the process may be modified by having the various stations perform their respective functions on different parts of the continuous fastener 10 spaced approximately at a triple index, a quadruple index, etc. either simultaneously or at generally the same time. In other words, the process could be modified to form three or more preseals, to form three or more notches within the preseals, to apply three or more sliders into the previously formed notches, and to apply three or more end stops proximate the previously applied sliders by having the various stations perform their respective functions on different parts of the continuous fastener 10 spaced approximately at a triple index, a quadruple index, etc. either simultaneously or at generally the same time. After applying the end stops 42*a*, 44*a* and 42*b*, 44*b* using the process described above, the fastener 10 is preferably applied to a flat web of plastic film that is then formed, filled with product, and made into individual plastic bags. Alternatively, the fastener 10 may be conveyed to a storage medium, such as a spool, and placed in an intermediate storage facility, and then applied to the plastic film at a later time.

Finished bags may be produced by attaching the slider-operated fastener to a flat web of plastic film and then conveying the web to a vertical or a horizontal form-fill-seal (FFS) machine. One example of a suitable method for attaching the slider-operated fastener to a flat web of plastic film and then conveying the web to a horizontal FFS machine is shown in FIG. 7. As used herein, the term form-fill-seal (FFS) means producing a bag or pouch from a flexible packaging material, inserting a measured amount of product, and closing the bag. The sliders may be mounted to the fastener either before or after the fastener is attached to a flat web of plastic film but prior to conveying the web to the FFS machine. Once the slider-operated fasteners have been attached to the flat web of plastic film, the web is conveyed to a vertical or horizontal FFS machine where the flat web is formed into bags, and the bags are successively filled and sealed.

FIG. 7 depicts one method for attaching the slider-operated fastener 10 to a flat web 50 of plastic film and then conveying the web 50 to a horizontal FFS machine. The fin 20 of the fastener 10 is "tacked" or lightly sealed to a web 50 of plastic film being unwound from a film roll 52. To tack the fastener fin 20 to the moving web 50, there is provided a pair of reciprocating seal bars 55, 57. Either both of the seal bars 55, 57 move back and forth between open and closed positions, or one of the seal bars is stationary while the other seal bar moves back and forth. Both the fastener 10 and the web 50 are temporarily stopped while the seal bars are brought together to tack the fastener 10 to the web 50. Of course, if the fastener 10 produced by the method in FIG. 1 is conveyed directly to the web 50, as opposed to an intermediate storage facility, the stoppage of the fastener 10 and web 50 for tacking can be made to coincide with the stoppage of the fastener 10 in FIG. 1 for forming the preseals and notches, applying the sliders, and forming the end stops. In an alternative embodiment, the seal bars 55, 57 are replaced with a continuous heat sealing mechanism such as a static hot air blower that blows hot air onto the moving fastener. The tacked fastener 10 is carried with the web 50 without shifting relative thereto.

After tacking the fastener 10 to the web 50, the fastener-carrying web 50 is conveyed to the horizontal FFS machine. At a folding station of the FFS machine, the web 50 is folded in half with the fastener 10 inside the web 50 and proximate the fold 51. To fold the web 50, the web 50 is conveyed over a horizontal roller 58, under a triangular folding board 60, and then between a pair of closely spaced vertical rollers 62. The folded web 50 includes a pair of overlapping panels 64, 66 joined along the fold 51.

After folding the web 50, the fastener fins 20, 22 are permanently sealed to the respective web panels 66, 64 by respective seal bars 68, 70. The seal bars 68, 70 are sufficiently wide that they generate the fin seals across the entire width of a bag. Either both of the seal bars 68, 70 move back and forth between open and closed positions, or one of the seal bars is stationary while the other seal bar moves back and forth. The fastener-carrying web 50 is temporarily stopped while the seal bars 68, 70 are brought together to seal the fastener 10 to the web 50. Both of the seal bars 68, 70 are preferably heated. The temperature, pressure, and dwell time of the seal bars 68, 70 are properly adjusted to allow the seal bars 68, 70 to generate the permanent fin seals. In an alternative embodiment, the seal bars 68, 70 are replaced with a continuous heat sealing mechanism such as a pair of hot air blowers that blow heated air onto the respective fastener fins.

After sealing the fins 20, 22 to the respective web panels 66, 64, the web panels 64, 66 are sealed to each other along a side seal 72 by a pair of reciprocating seal bars 74, 76. The side seal 72 is transverse to a direction of movement of the folded web 50 and is aligned with a center of notch 38*a* (and preseal 28) or notch 38*b* (and preseal 29). Also, the side seal 72 extends from the folded bottom 51 to an open top 53 of the folded web 50 Either both of the seal bars 74, 76 move back and forth between open and closed positions, or one of the seal bars is stationary while the other seal bar moves back and forth. The folded web 50 is temporarily stopped while the seal bars 74, 76 are brought together to seal the web panels 64, 66 to each other. At least one of the seal bars is heated. The other bar may be heated as well or may simply serve as a backing against which the heated seal bar applies pressure when the seal bars 74, 76 are brought together. The temperature, pressure, and dwell time of the seal bars 74, 76 are properly adjusted to allow the seal bars 74, 76 to generate the side seal 72. After generating the side seal 72, the folded web 50 is conveyed to a cutter 78 for separating the folded web 50 into individual plastic bags. While the folded web 50 is temporarily stopped, the cutter 78 cuts the folded web 50 along a center of the side seal 72 to produce the individual plastic bag 80. The plastic bag 80 is filled with a product through its open top 53 at a filling station 82. Finally, the open top 53 is sealed by a heat sealing mechanism 84. The end result is a filled and sealed bag 80 ready for shipment to a customer such as a grocery store or convenience store.

While the web 50 is temporarily stopped in the method depicted in FIG. 7, the various stations perform their respective functions on different parts of the continuous web 50 simultaneously or at generally the same time. For example, as the fastener 10 is tacked to the web 50 by the seal bars 55, 57, (1) the fastener fins 20, 22 of a previously tacked section of the fastener 10 can be permanently sealed to the respective web panels 64, 66 by respective seal bars 68, 70, (2) the web panels 64, 66 carrying previously sealed fastener fin sections can be sealed to each other along a side seal 72 by the seal bars 74, 76, and (3) the folded web 50 can be cut along a previously generated side seal. After each of the stations has completed its respective function on the stopped web 50, movement of the web 50 is resumed.

While the process described above is directed to a process for attaching the slider-operated fastener 10 to a flat web 50 of plastic film and then conveying the web 50 to a horizontal FFS machine, it is also contemplated that a vertical FFS machine may be used. Further details concerning the method of making the slider-operated fastener 10, attaching the slider-operated fastener 10 to the web 50 of plastic film, and making finished bags may be obtained from U.S. patent application Ser. No. 09/637,038 entitled "Method And Apparatus For Making Reclosable Plastic Bags Using A Pre-Applied Slider-Operated Fastener" which is herein incorporated by reference.

An alternative method of making a slider-operated fastener for use in reclosable plastic bags is shown in FIGS. 3 and 4*a*–4*e*. In this alternative method, a double index is used to apply at least two sliders to a fastener by moving or bending portions of the fastener into different planes to apply the sliders. In this method, there is provided a continuous fastener 110 as described above with respect to FIG. 1. The fastener 110 includes first and second opposing tracks 112, 114 which include respective first and second interlocking profiles 116, 118 and respective first and second fins 120, 122 extending downward from the respective profiles 116, 118 as described above with respect to FIG. 1.

The process depicted in FIG. 3 begins by performing a double index draw of fastener 110. The fastener 110 advances two bag-width distances forward by rollers and the like (not shown) to a preseal station similar to the one described above with respect to FIG. 1. The preseal station includes a first pair of reciprocating seal bars 124*a*, 126*a* and a second pair of reciprocating seal bars 124*b*, 126*b* operating as described above with respect to FIG. 1. As described above with respect to FIG. 1, while the fastener 110 is temporarily stopped at the preseal station, the fins 120, 122 are sealed to each other along the generally U-shaped preseals 128, 129. The preseals 128, 129 which are formed are similar to those described above with respect to FIG. 1. Preseal 128 includes a pair of opposing sides 128*a*, 128*b* and a bottom 128*c* bridging the opposing sides 128*a*, 128*b* while preseal 129 includes a pair of opposing sides 129*a*, 129*b* and a bottom 129*c* bridging the opposing sides 129*a*, 129*b*. The seal bars 124*a*, 124*b* have generally U-shaped projections 130*a*, 130*b* which correspond to the shape of the preseals 128, 129, respectively. In addition, as described above with respect to FIG. 1, although the preseals 128, 129 are shown as being generally U-shaped, the area between the opposing sides 128*a*, 128*b* and 129*a*, 129*b* of the preseals 128, 129, respectively, may also be sealed so that the preseals 128, 129 appear like solid rectangles. The preseals 128, 129 extend to the bottom of the profiles 116, 118.

After forming the preseals 128, 129, the fastener 110 is double indexed forward as shown in FIG. 3 to a notching station similar to that described above with respect to FIG. 1. The notching station includes a first pair of reciprocating cutters 132*a*, 134*a* and a second pair of reciprocating cutters 132*b*, 134*b*. Cutters 132*a*, 132*b* form rectangular projections while cutters 134*a*, 134*b* form rectangular holes for receiving the respective projection. As described above with respect to FIG. 1, the fastener 110 is temporarily stopped at the notching station so that preseals 128, 129 become aligned between the separated pairs of reciprocating cutters 132*a*, 134*a* and 132*b*, 134*b*, respectively. While the fastener 110 is temporarily stopped, the cutters 132*a*, 134*a* and 132*b*, 134*b* are brought together such that the rectangular projections of the cutters 132*a*, 132*b* punch rectangular sections 136*a*, 136*b* through the rectangular holes of the respective cutters 134*a*, 134*b* leaving generally U-shaped notches 138*a*, 138*b* in the fastener 110. Prior to being punched out, the rectangular sections 136*a*, 136*b* are disposed between the opposing sides 128*a*, 128*b* and 129*a*, 129*b* of the preseals 128, 129 and above the bottoms 128*c*, 129*c* of the preseals 128, 129. As discussed above, other cutting devices (not shown) such as rotary cutters may be used in embodiments of the invention.

As discussed above, the notches 138*a*, 138*b* assist in defining or forming the first and second segments 154*a*, 154*b*, respectively, on the tracks 112, 114 of the fastener 110. The second segment 154*b* of the fastener 110 is located downstream from and adjacent to notch 138*b*. The first segment 154*a* is located upstream from the second segment 154*b* and is located between notch 138*a* and notch 138*b*. The notches 138*a*, 138*b* are sufficiently wide to hold at least one slider.

Instead of forming generally U-shaped notches 138*a*, 138*b* in the fastener 110 as described above, a cut or slit may be made in the fastener 110. Further details concerning the construction of the formation of a cut or slit in the fastener 110 may be obtained from U.S. Pat. No. 5,431,760 to Donovan, which is incorporated herein by reference in its entirety.

After forming the notches 138*a*, 138*b*, the fastener 110 is double indexed forward to a slider inserter station. As shown in FIGS. 3 and 4*a*–4*e*, the slider inserter station includes first and second slider inserter units 155*a*, 155*b* which are located at two separate application sites. During the double index of the fastener 110, notch 138*a* becomes aligned with the first slider inserter unit 155*a* and is labeled notch 138*c* and notch 138*b* becomes aligned with the second slider inserter unit 155*b* and is labeled notch 138*d*. Each slider inserter unit 155*a*, 155*b* includes at least one row of sliders. The slider inserter units 155*a*, 155*b* remain stationary as the fastener 110 indexes forward. The slider insert units 155*a*, 155*b* may be, for example, gravity feeders, power feeders, or mechanically driven feeders.

At the slider inserter station, a first slider 140*a* is applied onto the second segment 154*b* of the tracks 112, 114 and a second slider 140*b* is applied onto the third segment 154*c* of the tracks 112, 114 through the process detailed below and shown in FIGS. 3 and 4*a*–4*e*.

Figure 4A:
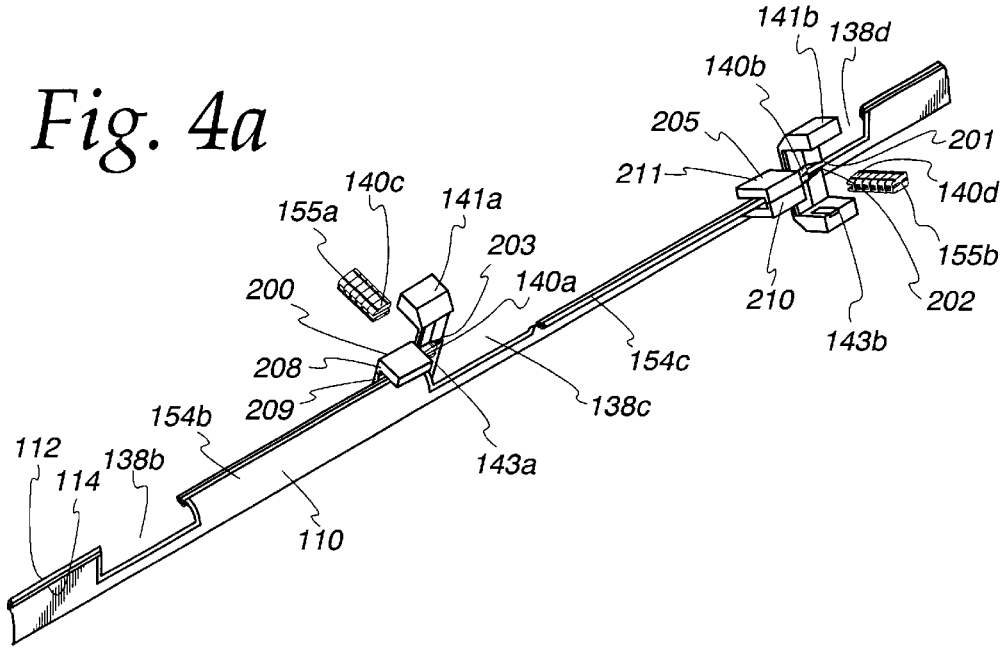

As shown in FIGS. 3 and 4*a*, the slider inserter station includes a first fastener guide 200 and a second fastener guide 205. The first fastener guide 200 is located on the second segment 154*b* of the fastener 110 and upstream from the first slider inserter unit 155*a*. The second fastener guide 205 is located on the third segment 154*c* of the fastener 110 and upstream from the second slider inserter unit 155*b*. The first fastener guide 200 includes a first and a second fastener guide portion 208, 209. The second fastener guide 205 includes a first and a second fastener guide portion 210, 211. The first and second fastener guides 200, 205 assist in positioning the fastener 110 for threading the first and second sliders 140*a*, 140*b* onto the second and third segments 154*b*, 154*c*, respectively, on the tracks 112, 114 of the fastener 110. The first and second fastener guides 200, 205 remain positioned upstream from the respective first and second slider inserter units 155*a*, 155*b* during the indexing process.

The slider inserter station further includes a first pair of grippers 141*a*, 143*a* and a second pair of grippers 141*b*, 143*b* which assist in holding and positioning the first and second sliders 140*a*, 140*b*, respectively, as the sliders move along the tracks 112, 114. The first and second pair of grippers 141*a*, 143*a* and 141*b*, 143*b* have tapered edges 203, 204 and 201, 202, respectively, and are similar to those described above with respect to FIG. 1 and as shown in FIG. 2*c*. As described above with respect to FIG. 1, the tapered edges 203, 204 and 201, 202 of the first and second pair of grippers 141*a*, 143*a* and 141*b*, 143*b*, respectively, close the tracks 112, 114 which are opened when the first and second sliders 140*a*, 140*b* are applied onto the fastener 110. Using the tapered edges 203, 204 and 201, 202 of the first and second pair of grippers 141*a*, 143*a* and 141*b*, 143*b*, respectively, to close the tracks 112, 114 also makes the subsequent step of forming end stops on the bag ends (described below) easier. As shown in FIG. 3, the fastener 110 temporarily stops with notch 138*c* positioned below the first slider inserter unit 155*a* and notch 138*d* positioned below the second slider inserter unit 155*b*. As shown in FIG. 3, the second segment 154*b* is bent into a first plane and the third segment 154*c* is bent into a second plane. The first and second planes are positioned or bent at an angle relative to one another that is sufficient to allow the trailing slider 140*b* to avoid interfering with the first and second slider inserter units 155*a*, 155*b* or the first and second pair of grippers 141*a*, 143*a* and 141*b*, 143*b*. The first and second planes may be positioned at an angle relative to one another which is at least about 20° and less than about 100°.

The second and third segments 154*b*, 154*c* of the tracks 112, 114 of the fastener 110 may be positioned at a sufficient angle relative to one another to avoid interfering with the first and second slider inserter units 155*a*, 155*b* or the first and second pair of grippers 141*a*, 143*a* and 141*b*, 143*b* through a variety of methods. One suitable method (not shown) involves pivoting the first and second slider inserter units 155*a*, 155*b* in from the side and using the first and second slider inserter units 155*a*, 155*b* to move or bend the second and third segments 154*b*, 154*c* of the tracks 112, 114 into the first and second planes, respectively, while the fastener 110 is temporarily stopped (i.e., at dwell). Another suitable method involves using separate fingers (not shown) to move or bend the second and third segments 154*b*, 154*c* of the tracks 112, 114 into the first and second planes, respectively, either while the fastener 110 is temporarily stopped (i.e., at dwell) or while the fastener 110 is being indexed.

Alternatively, only one of the segments of the tracks 112, 114 may be bent to avoid interfering with the first and second slider inserter units 155*a*, 155*b* or the first and second pair of grippers 141*a*, 143*a* and 141*b*, 143*b*. Specifically, the third segment 154*c* of the tracks 112, 114 may be bent into a plane which is transverse or horizontal to the tracks 112, 114 of the fastener 110 at an angle that is sufficient to allow slider 140*b* to avoid interfering with the first and second slider inserter units 155*a*, 155*b* or the first and second pair of grippers 141*a*, 143*a* and 141*b*, 143*b* while the second segment 154*b* is retained in the same plane as the tracks 112, 114 of the fastener 110.

Alternatively, the second segment 154*b* of the tracks 112, 114 may be bent into a plane which is transverse or horizontal to the tracks 112, 114 of the fastener 110 at an angle that is sufficient to allow slider 140*a* to avoid interfering with the second slider inserter unit 155*b* or the second pair of grippers 141*b*, 143*b* while the third segment 154*c* is retained in the same plane as the tracks 112, 114 of the fastener 110.

As shown in FIGS. 3 and 4*a*, the first slider inserter unit 155*a* feeds the first slider 140*a* into the notch 138*c* and the second slider inserter unit 155*b* feeds the second slider 140*b* into the notch 138*d* at generally the same time while the fastener 110 is temporarily stopped (i.e., at dwell). The first pair of grippers 141*a*, 143*a* and the second pair of grippers 141*b*, 143*b* are positioned to allow the first and second slider inserter units 155*a*, 155*b* to feed the first and second sliders 140*a*, 140*b* into notches 138*c*, 138*d*, respectively, unobstructed. The next two sliders 140*c*, 140*d* that are resting in the first and second slider inserter units 155*a*, 155*b* are retained in the first and second slider inserter units 155*a*, 155*b*, respectively, until the next double index of the fastener 110. A stop (not shown) such as an escapement or mechanical latch on the first and second slider inserter units 155*a*, 155*b* prevents or inhibits sliders 140*c*, 140*d* from feeding into the notches 138*c*, 138*d* as the fastener 110 indexes forward during the next double index draw.

As shown in FIGS. 3 and 4*a*, the first pair of grippers 141*a*, 143*a* and the second pair of grippers 141*b*, 143*b* are closed around the first and second sliders 140*a*, 140*b*, respectively, as the first and second slider inserter units 155*a*, 155*b* feed the first and second sliders 140*a*, 140*b* into the notches 138*c*, 138*d*, respectively. Alternatively, the first pair of grippers 141*a*, 143*a* and the second pair of grippers 141*b*, 143*b* may be open when the first and second slider inserter units 155*a*, 155*b* feed the first and second sliders 140*a*, 140*b* into the respective notches 138*c*, 138*d*. In this alternative approach, the first pair of grippers 141*a*, 143*a* may be activated to come in from the side and close around the first slider 140*a* and the second pair of grippers 141*b*, 143*b* may be activated to come in from the side and close around the second slider 140*b* while the fastener 110 is at dwell.

Once the first and second sliders 140*a*, 140*b* are in position within the notches 138*c*, 138*d* respectively, the first slider 140*a* is now in position to become applied or threaded onto the second segment 154*b* of the tracks 112, 114 and the second slider 140*b* is now in position to become applied or threaded onto the third segment 154*c* of the tracks 112, 114 once the double index of the fastener 110 begins.

Figure 4B:
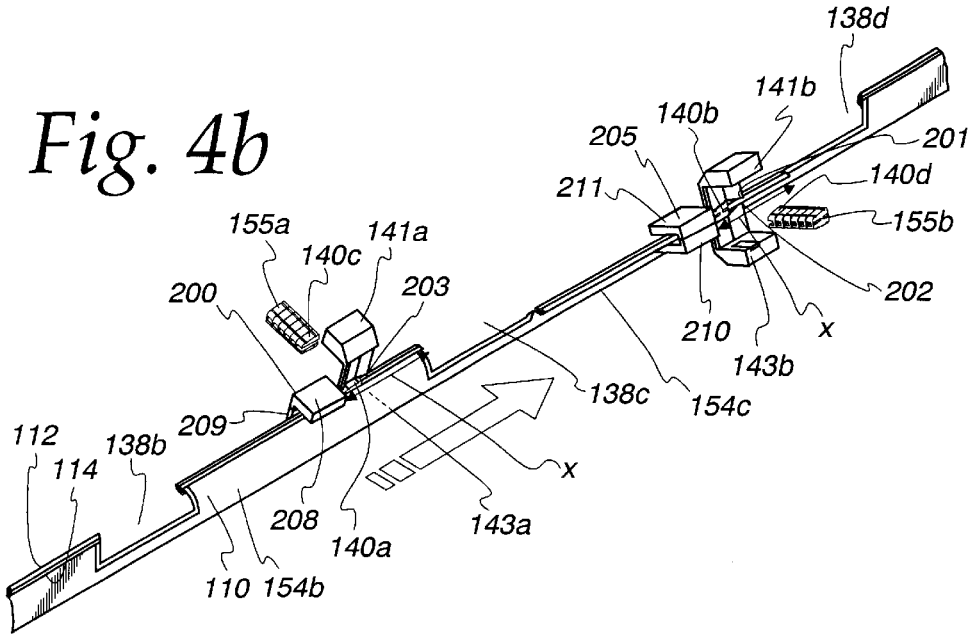
Figure 4C:
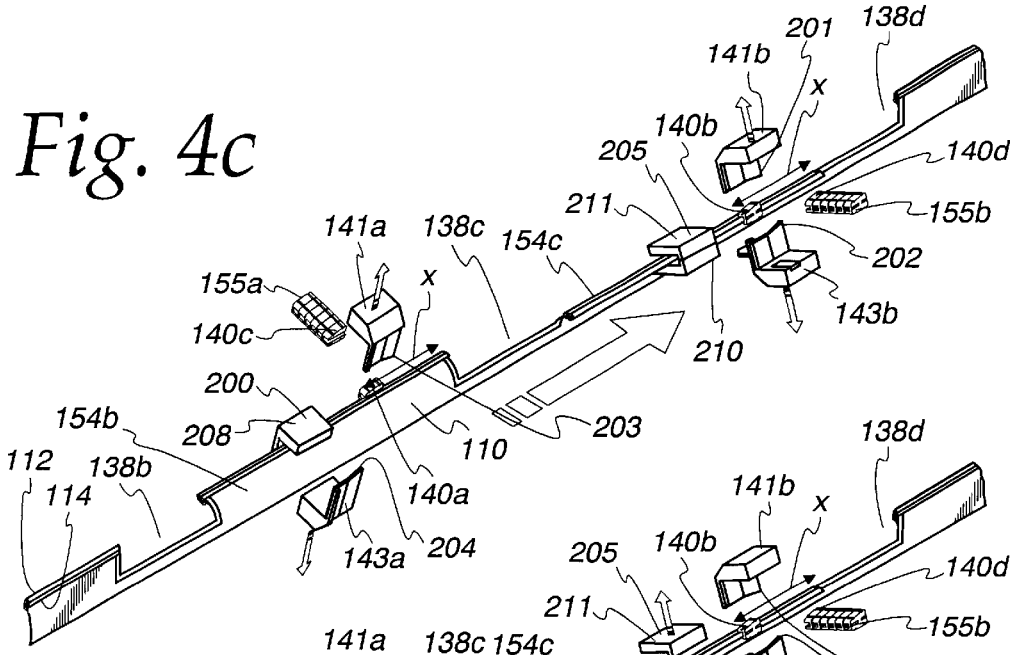
Figure 4D:
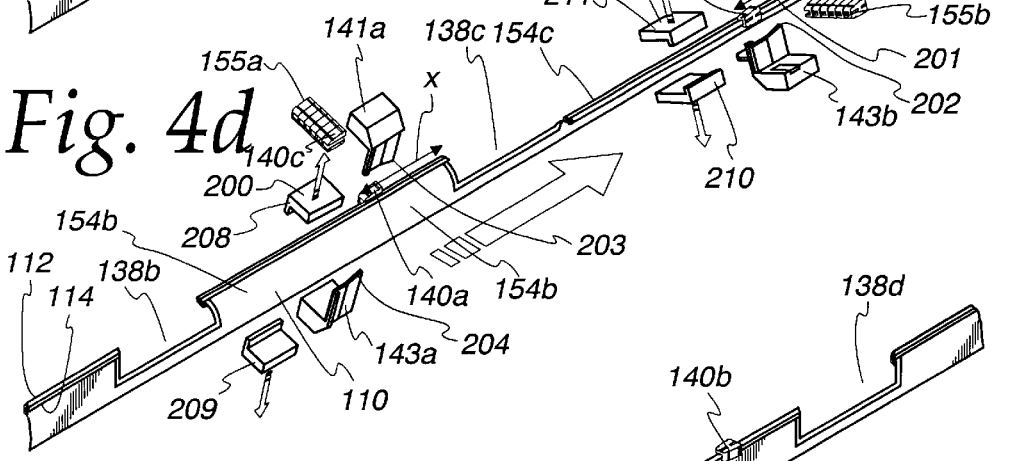

As shown in FIG. 3, at the beginning of the double index, notch 138*c* is positioned directly below the first slider inserter unit 155*a* while notch 138*d* is positioned directly below the second slider inserter unit 155*b*. FIGS. 3 and 4*a* show the fastener 110 beginning its double index forward. Once the fastener 110 begins its double index forward, the fastener 110 does not stop moving until a full double index has been completed. As the fastener 110 begins its index, the first slider 140*a* becomes applied or threaded onto the second segment 154*b* of the tracks 112, 114 and the second slider 140*b* becomes applied or threaded onto the third segment 154*c* of the tracks 112, 114 at generally the same time. As index of the fastener 110 is initiated, the first and second pair of grippers 141*a*, 143*a* and 141*b*, 143*b* remain closed around the first and second sliders 140*a*, 140*b*, respectively, to assist in guiding the first and second sliders 140*a*, 140*b* onto the tracks 112, 114. Specifically, the first pair of grippers 141*a*, 143*a* assist in applying the first slider 140*a* onto the second segment 154*b* of the tracks 112, 114. The second pair of grippers 141*b*, 143*b* assist in applying the second slider 140*b* onto the third segment 154*c* of the tracks 112, 114. As shown in FIG. 4*a*, once the first slider 140*a* has been applied onto the second segment 154*b*, the tapered edges 203, 204 on the first pair of grippers 141*a*, 143*a* close the tracks 112, 114. Once the second slider 140*b* has been applied onto the third segment 154*c*, the tapered edges 201, 202 on the second pair of grippers 141*b*, 143*b* close the tracks 112, 114. As described with respect to FIG. 1 and FIGS. 2*a*–2*d*, the step of closing the tracks may be accomplished by methods other than using tapered edges on the first and second pair of grippers 141*a*, 143*a* and 141*b*, 143*b*. As shown in FIGS. 4*b*–4*d*, once the fastener 110 has been indexed a distance x from the respective notches 138*c*, 138*d*, the first pair of grippers 141*a*, 143*a* and the second pair of grippers 141*b*, 143*b* open, respectively. Also, once the fastener 110 has been indexed a distance x from the respective notches 138*c*, 138*d*, the first and second fastener guide portions 208, 209 of the first fastener guide 200 and the first and second fastener guide portions 210, 211 of the second fastener guide 205 open, respectively. Distance x is set using conventional techniques for indexing fixed distances of flexible material as described above with respect to FIG. 1. The first and second fastener guide portions 208, 209 of the first fastener guide 200 and the first and second fastener guide portions 210, 211 of the second fastener guide 205 may open simultaneously or at generally the same time. Alternatively, the first and second pair of grippers 141*a*, 143*a* and 141*b*, 143*b* and the first and second fastener guide portions 208, 209 and the first and second fastener guide portions 210, 211 may open simultaneously or at generally the same time. By opening the first pair of grippers 141*a*, 143*a* and the first and second fastener guide portions 208, 209 of the first fastener guide 200, the first slider 140*a* becomes released to travel with the second segment 154*b* of the tracks 112, 114. By opening the second pair of grippers 141*b*, 143*b* and the first and second fastener guide portions 210, 211 of the second fastener guide 205, the second slider 140*b* becomes released to travel with the third segment 154*c* of the tracks 112, 114.

Figure 4E:
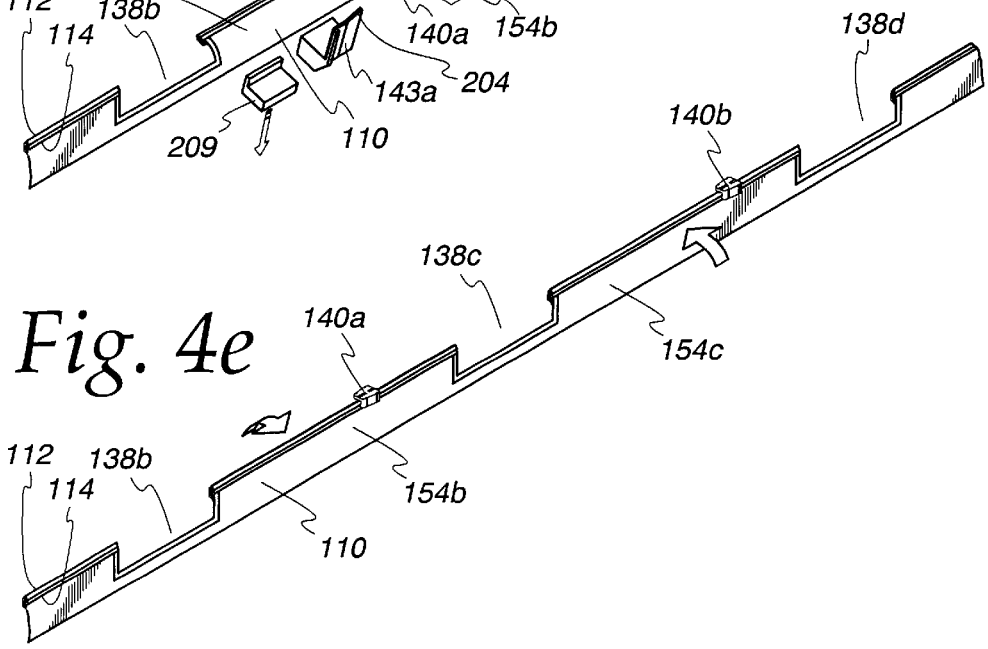

As shown in FIG. 4*e*, once the first slider 140*a* has been applied onto the second segment 154*b* of the tracks 112, 114 and the second slider 140*b* has been applied onto the third segment 154*c* of the tracks 112, 114, the second and third segments 154*b*, 154*c* are rotated such that each segment is again in the same plane as the remainder of the tracks 112, 114 of the fastener 110 (i.e., in a vertical position as depicted in FIG. 4*e*). By rotating the second and third segments 154*b*, 154*c* back into the same plane as the remainder of the tracks 112, 114, the second and third segments 154*b*, 154*c* may proceed to an end stop applicator station. The first and second pair of grippers 141*a*, 143*a* and 141*b*, 143*b* may move to facilitate the rotation of the second and third segments 154*b*, 154*c*. FIG. 4*e* shows the fastener 110 upon completion of the double index without the first and second pair of grippers 141*a*, 143*a* and 141*b*, 143*b*.

Through the process detailed above and as shown in FIGS. 3 and 4*a*–4*e*, the first slider 140*a* is applied onto the second segment 154*b* of the tracks 112, 114 and the second slider 140*b* is applied onto the third segment 154*c* of the tracks 112, 114.

After applying the first and second sliders 140*a*, 140*b* onto the second and third segments 154*b*, 154*c* of the fastener 110, respectively, and rotating the second and third segments 154*b*, 154*c* back into the same plane as the remainder of the tracks 112, 114, the double index of the fastener 110 is completed such that notches 138*c*, 138*d* become positioned at an end stop applicator station similar to the one described with respect to FIG. 1. In the embodiment shown in FIG. 3, notch 138*c* becomes positioned between a first pair of chilled, reciprocating molds 147*a*, 149*a* and is labeled notch 138*e*. The second segment 154*b* which contains slider 140*a* (labeled 140*e*) becomes positioned upstream from the first pair of chilled, reciprocating molds 147*a*, 149*a* and notch 138*e* and is labeled 154*d*. Also as shown in FIG. 3, notch 138*d* becomes positioned between a second pair of chilled, reciprocating molds 147*b*, 149*b* and is labeled notch 138*f* The third segment 154*c* which contains slider 140*b* (labeled 140*f*) becomes positioned upstream from the second pair of chilled, reciprocating molds 147*b*, 149*b* and notch 138*f* and is labeled 154*e*. Also upon completing the double index, notch 138*a* becomes positioned below the first slider inserter unit 155*a* (see notch labeled 138*c* in FIG. 3) and notch 138*b* becomes positioned below the second slider inserter unit 155*b* (see notch labeled 138*d* in FIG. 3) such that the next two sliders 140*c*, 140*d* which are resting in the first and second slider inserter units 155*a*, 155*b*, respectively, are ready to be fed into notches 138*c*, 138*d*, respectively.

At the end stop applicator station, the end stop applicator applies end stops 142*a*, 144*a* and 142*b*, 144*b* to the respective fastener ends 146*a*, 148*a* and 146*b*, 148*b* on opposite sides of the respective notches 138*e*, 138*f* In the plastic bags ultimately formed by the manufacturing process, end stop 142*a*is located at the fastener end 146*a* of one bag, end stop

144*a* is located at the fastener end 148*a* of the adjacent bag, while end stop 142*b* is located at the fastener end 146*b* of one bag and end stop 144*b* is located at the fastener end 148*b* of the adjacent bag.

The end stop applicator station may include a first pair of chilled, reciprocating molds 147*a*, 149*a* and a second pair of chilled, reciprocating molds 147*b*, 149*b* which operate similar to those shown in FIG. 1 and described above with respect to FIG. 1. Also as described above with respect to FIG. 1, instead of applying injection-molded end stops, other types of end stops may be applied to the fastener ends 146*a*, 146*b*, 148*a*, 148*b*.

While the fastener 110 is temporarily stopped during the dwell phase of the cycle in the method depicted in FIGS. 3 and 4*a*–4*e*, the various stations perform their respective functions on different parts of the continuous fastener 110 spaced apart at approximately at a double index (i.e., approximately two bag-width distances apart) either simultaneously or at generally the same time. Therefore, as (1) the preseal station forms new preseals 128, 129, (2) the notching station forms new notches 138*a*, 138*b* within the previously formed preseals 128, 129; (3) the slider insertion station applies sliders 140*a*, 140*b* into the notches 138*c*, 138*d*; and (4) the end stop applicator applies end stops 142*a*, 144*a* and 142*b*, 144*b* proximate the previously applied sliders at approximately the same time. Dwell is accomplished as described above with respect to FIG. 1. After each of the stations has completed its respective function on the temporarily stopped fastener 110, movement of the fastener 110 is resumed. The fastener 110 is moved approximately two bag-width distances forward so that the next station can perform its respective function as described above with respect to FIG. 1.

While the process described above is directed to a process of forming two preseals, forming two notches within the preseals, applying two sliders into the previously formed notches, and applying two end stops proximate the previously applied sliders by having the various stations perform their respective functions on different parts of the continuous fastener 110 spaced approximately at a double index either simultaneously or at generally the same time, it is contemplated that the process may be modified. For example, the process may be modified by having the various stations perform their respective functions on different parts of the continuous fastener 110 spaced approximately at a triple index, a quadruple index, etc. either simultaneously or at generally the same time. In other words, the process could be modified to form three or more preseals, to form three or more notches within the preseals, to apply three or more sliders into the previously formed notches, and to apply three or more end stops proximate the previously applied sliders by having the various stations perform their respective functions on different parts of the continuous fastener 110 spaced approximately at a triple index, a quadruple index, etc. either simultaneously or at generally the same time. After applying the end stops 142*a*, 144*a* and 142*b*, 144*b* using the process described above, the fastener 110 is preferably applied to a flat web of plastic film that is then formed, filled with product, and made into individual plastic bags as described above with respect to FIG. 1. As described above, the fastener 110 may alternatively be conveyed to a storage medium, such as a spool, and placed in an intermediate storage facility, and then applied to the plastic film at a later time. Finished bags may be produced by attaching the slider-operated fastener to a flat web of plastic film and then conveying the web to a vertical FFS machine or a horizontal FFS machine as described above with respect to FIG. 1. As described above, FIG. 7 depicts one method for attaching the slider-operated fastener 110 to a flat web of plastic film. An additional alternative method of making a slider-operated fastener for use in reclosable plastic bags is shown in FIGS. 5 and 6*a*–6*d*. In this embodiment, a double index is used to apply at least two sliders to a fastener via two slider inserter units and opening a guider to allow the trailing slider to travel along on the tracks of the fastener. In this method, there is provided a continuous fastener 210 as described above with respect to FIG. 1. The fastener 210 includes first and second opposing tracks 212, 214 which include respective first and second interlocking profiles 216, 218 and respective first and second fins 220, 222 extending downward from the respective profiles 216, 218 as described above with respect to FIG. 1.

The process depicted in FIG. 5 begins by performing a double index draw of fastener 210. The fastener 210 advances two bag-width distances forward by rollers and the like (not shown) to a preseal station similar to the one described above with respect to FIG. 1. The preseal station includes a first pair of reciprocating seal bars 224*a*, 226*a* and a second pair of reciprocating seal bars 224*b*, 226*b* operating as described above with respect to FIG. 1. As described above with respect to FIG. 1, while the fastener 210 is temporarily stopped at the preseal station, the fins 220, 222 are sealed to each other along the generally U-shaped preseals 228, 229. The preseals 228, 229 are similar to those described above with respect to FIG. 1. Preseal 228 includes a pair of opposing sides 228*a*, 228*b* and a bottom 228*c* bridging the opposing sides 228*a*, 228*b* while preseal 229 includes a pair of opposing sides 229*a*, 229*b* and a bottom 229*c* bridging the opposing sides 229*a*, 229*b*. The seal bars 224*a*, 224*b* have generally U-shaped projections 230*a*, 230*b* which correspond to the shape of the respective preseals 228, 229. In addition, as described above with respect to FIG. 1, although the preseals 228, 229 are shown as being generally U-shaped, the area between the opposing sides 228*a*, 228*b* and 229*a*, 229*b* of the preseals 228, 229, respectively, may also be sealed so that the preseals 228, 229 appear like solid rectangles. The preseals 228, 229 extend to the bottom of the profiles 216, 218.

After forming the preseals 228, 229, the fastener 210 is double indexed forward to a notching station as shown in FIG. 5. The notching station operates similar to that shown in FIG. 1 and described above. The notching station includes a first pair of reciprocating cutters 232*a*, 234*a* and a second pair of reciprocating cutters 232*b*, 234*b*. Cutters 232*a*, 232*b* form rectangular projections while cutters 234*a*, 234*b* form rectangular holes for receiving the respective projection. As described above with respect to FIG. 1, the fastener 210 is temporarily stopped at the notching station so that preseals 228, 229 become aligned between the separated pairs of reciprocating cutters 232*a*, 234*a* and 232*b*, 234*b*, respectively. While the fastener 210 is temporarily stopped, the cutters 232*a*, 234*a* and 232*b*, 234*b* are brought together such that the rectangular projections of the cutters 232*a*, 232*b* punch rectangular sections 236*a*, 236*b* through the rectangular holes of the respective cutters 232*a*, 234*b* leaving generally U-shaped notches 238*a*, 238*b* in the fastener 210. Prior to being punched out, the rectangular sections 236*a*, 236*b* are disposed between the opposing sides 228*a*, 228*b* and 229*a*, 229*b* of the preseals 228, 229 and above the bottoms 228*c*, 229*c* of the preseals 228, 229. Although the notching station has been described as being equipped with reciprocating cutters, other cutting devices (not shown) such as rotary cutters may be used in embodiments of the invention.

As discussed above, the notches 238*a*, 238*b* assist in defining or forming the first and second segments 254*a*, 254*b* on the tracks 212, 214, respectively, of the fastener 210. The second segment 254*b* of the fastener 210 is located downstream from and adjacent to notch 238*b*. The first segment 254*a* of the fastener 210 is located upstream from the second segment 254*b* and is located between notch 238*a* and notch 238*b*. The notches 238*a*, 238*b* are sufficiently wide to hold at least one slider.

After forming the notches 238*a*, 238*b*, the fastener 210 is double indexed forward to a slider inserter station. As shown in FIGS. 5 and 6*a*–6*d*, the slider inserter station includes first and second slider inserter units 255*a*, 255*b* which are located at two separate application sites. During the double index of the fastener 210, notch 238*a* becomes aligned with the first slider inserter unit 255*a* and is labeled notch 238*c* and notch 238*b* becomes aligned with the second slider inserter unit 255*b* and is labeled notch 238*d*. Each slider inserter unit 255*a*, 255*b* includes at least one row of sliders. The slider inserter units 255*a*, 255*b* remain stationary as the fastener 210 indexes forward. The slider insert units 255*a*, 255*b* may be, for example, gravity feeders, power feeders, or mechanically driven feeders.

At the slider inserter station, a first slider 240*a* is applied onto the second segment 254*b* of the tracks 212, 214 and a second slider 240*b* is applied onto the third segment 254*c* of the tracks 212, 214 through the process detailed below and shown in FIGS. 5 and 6*a*–6*d*.

Figure 6A:
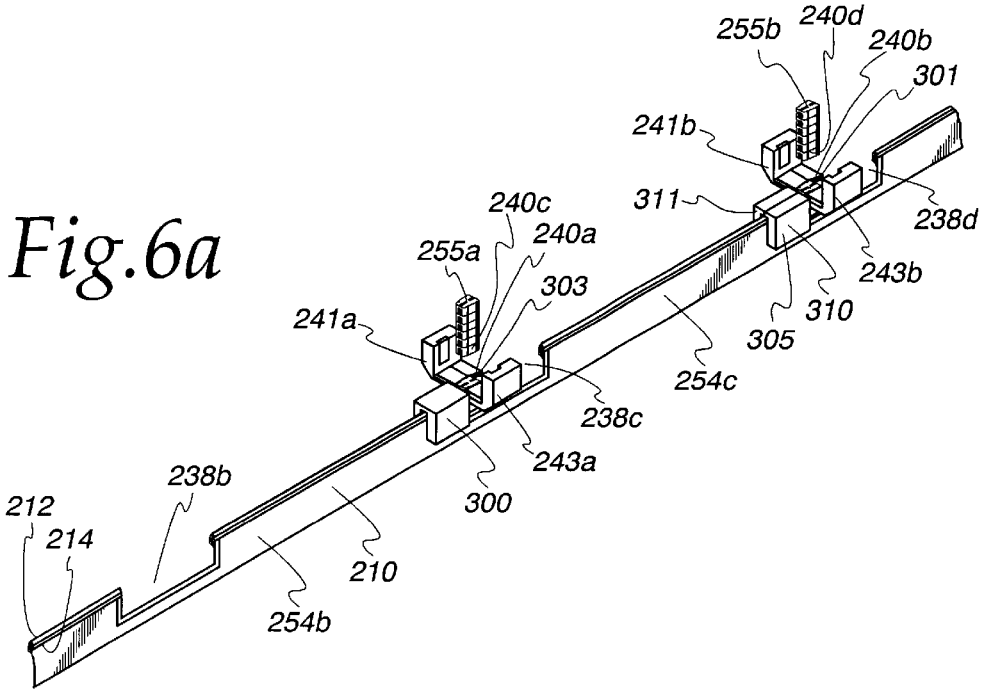

As shown in FIGS. 5 and 6*a*, the slider inserter station includes a first fastener guide 300 and a second fastener guide 305. The first fastener guide 300 is located on the second segment 254*b* of the fastener 210 and upstream from the first slider inserter unit 255*a*. The second fastener guide 305 is located on the third segment 254*c* of the fastener 210 and upstream from the second slider inserter unit 255*b*. The second fastener guide 305 includes a first and a second fastener guide portion 310, 311. The first and second fastener guides 300, 305 assist in positioning the fastener 210 for threading the first and second sliders 240*a*, 240*b* onto the second and third segments 254*b*, 254*c*, respectively, on the tracks 212, 214 of the fastener 210. The first and second fastener guides 200, 205 remain positioned upstream from the respective first and second slider inserter units 255*a*, 255*b* during indexing.

The slider inserter station further includes a first pair of grippers 241*a*, 243*a* and a second pair of grippers 241*b*, 243*b* which assist in holding and positioning the first and second sliders 240*a*, 240*b*, respectively, as the sliders move along the tracks 212, 214. The first and second pair of grippers 241*a*, 243*a* and 241*b*, 243*b* have tapered edges 303, 304 and 301, 302, respectively, and are similar to those described above with respect to FIG. 1 and as shown in FIG. 2*c*. As described above with respect to FIG. 1, the tapered edges 303, 304 and 301, 302 of the first and second pair of grippers 241*a*, 243*a* and 241*b*, 243*b* respectively, close the tracks 212, 214 which are opened when the first and second sliders 240*a*, 240*b* are applied onto the fastener 210. By closing the tracks 212, 214 with the respective tapered edges 303, 304 and 301, 302 of the first and second pair of grippers 241*a*, 243*a* and 241*b*, 243*b*, the subsequent step of forming end stops on the bag ends (described below) is easier.

As shown in FIG. 5 the fastener 210 temporarily stops with notch 238*c* positioned below the first slider inserter unit 255*a* and notch 238*d* positioned below the second slider inserter unit 255*b*. While the fastener 210 is temporarily stopped (i.e., at dwell), the first slider inserter unit 255*a* feeds the first slider 240*a* into the notch 238*c* and the second slider inserter unit 255*b* feeds the second slider 240*b* into the notch 238*d* at generally the same time. The first pair of grippers 241*a*, 243*a* and the second pair of grippers 241*b*, 243*b* are positioned to allow the first and second slider inserter units 255*a*, 255*b* to feed the first and second sliders 240*a*, 240*b* into notches 238*c*, 238*d*, respectively, unobstructed. The next two sliders 240*c*, 240*d* that are resting in the first and second slider inserter units 255*a*, 255*b*, respectively, are retained in the first and second slider inserter units 255*a*, 255*b* until the next double index of the fastener 210. A stop (not shown) such as an escapement or mechanical latch on the first and second slider inserter units 255*a*, 255*b* prevents or inhibits sliders 240*c*, 240*d* from feeding into the notches 238*c*, 238*d* as the fastener 210 indexes forward during the next double index draw.

As shown in FIGS. 5 and 6*a*, the first pair of grippers 241*a*, 243*a* and the second pair of grippers 241*b*, 243*b* are closed around the first and second sliders 240*a*, 240*b*, respectively, as the first and second slider inserter units 255*a*, 255*b* feed the first and second sliders 240*a*, 240*b* into the notches 238*c*, 238*d*, respectively. Alternatively, the first pair of grippers 241*a*, 243*a* and the second pair of grippers 241*b*, 243*b* may be open when the first and second slider inserter units 255*a*, 255*b* feed the first and second sliders 240*a*, 240*b* into the respective notches 238*c*, 238*d*. In this alternative approach, the first pair of grippers 241*a*, 243*a* may be activated to come in from the side and close around the first slider 240*a* and the second pair of grippers 241*b*, 243*b* may be activated to come in from the side and close around the second slider 240*b* while the fastener 210 is at dwell. Once the first and second sliders 240*a*, 240*b* are in position within the notches 238*c*, 238*d* respectively, the first slider 240*a* is now in position to become applied or threaded onto the second segment 254*b* and the second slider 240*b* is now in position to become applied or threaded onto the third segment 254*c* of the tracks 212, 214 once the double index of the fastener 210 begins.

Figure 6B:
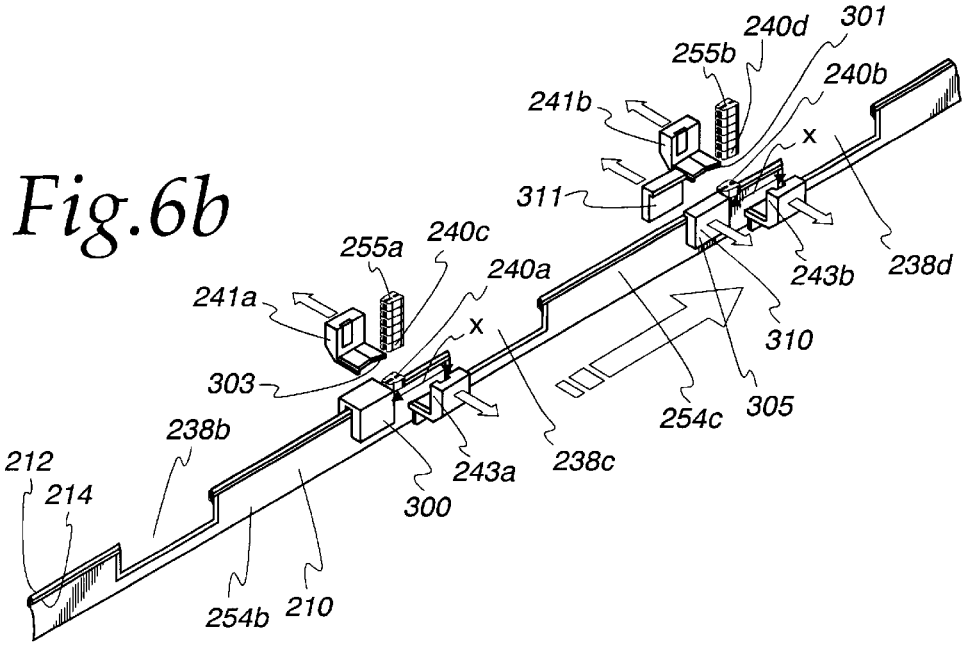
Figure 6C:
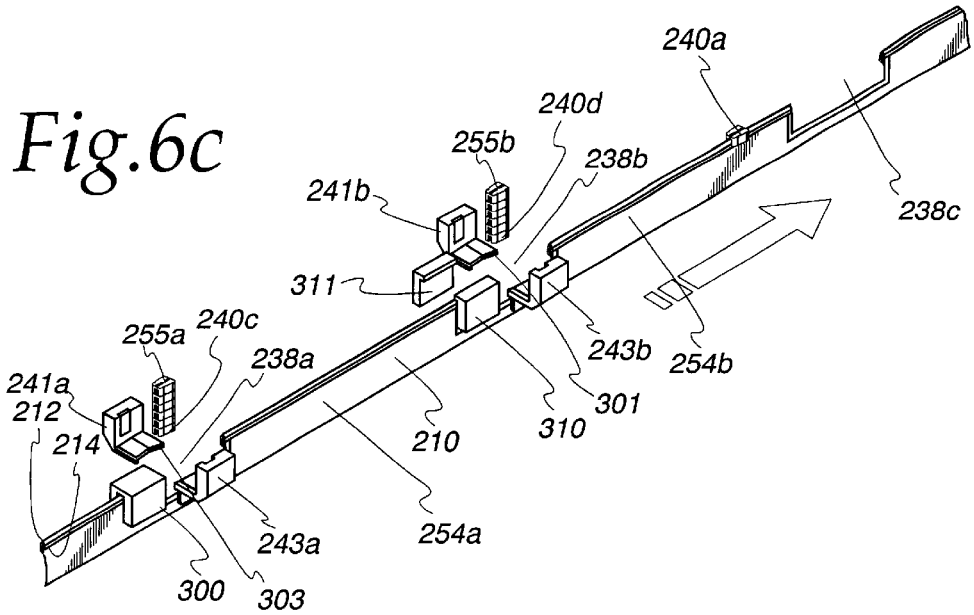

As shown in FIG. 5, at the beginning of the double index, notch 238*c* is positioned directly below the first slider inserter unit 255*a* while notch 238*d* is positioned directly below the second slider inserter unit 255*b*. FIG. 6*a* shows the fastener 210 beginning its double index forward. Once the fastener 210 begins its double index forward, the fastener 210 does not stop moving until a full double index has been completed. As the fastener 210 begins its index, the first slider 240*a* becomes applied or threaded onto the second segment 254*b* of the tracks 212, 214 and the second slider 240*b* becomes applied or threaded onto the third segment 254*c* of the tracks 212, 214 at generally the same time. As index of the fastener 210 is initiated, the first and second pair of grippers 241*a*, 243*a* and 241*b*, 243*b* remain closed around the first and second sliders 240*a*, 240*b*, respectively, to assist in guiding the first and second sliders 240*a*, 240*b* onto the tracks 212, 214. Specifically, the first pair of grippers 241*a*, 243*a* assist in applying the first slider 240*a* onto the second segment 254*b* of the tracks 212, 214. The second pair of grippers 241*b*, 243*b* assist in applying the second slider 240*b* onto the third segment 254*c* of the tracks 212, 214. As shown in FIGS. 6*a*–6*c*, once the fastener 210 has been indexed a distance x from the respective notches 238*c*, 238*d* the first pair of grippers 241*a*, 243*a* and the second pair of grippers 241*b*, 243*b* open, respectively. By opening the first pair of grippers 241*a*, 243*a*, the first slider 240*a* becomes released to travel with the second segment 254*b* of the tracks 212, 214. Distance x is set using conventional techniques for indexing fixed distances of flexible material as described above with respect to FIG. 1. By opening the second pair of grippers 241*b*, 243*b*, the second slider 240*b* becomes released to travel with the third segment 254*c* of the tracks 212, 214. Also, once the fastener 210 has been indexed a distance x from notch 238*d* the first and second fastener guide portions 310, 311 of the second fastener guide 305 open to allow the trailing slider 240*b* to pass by unobstructed during the fastener 210 index. The first pair of grippers 241*a*, 243*a* and the second pair of grippers 241*b*, 243*b* and the first and second fastener guide portions 301, 311 of the second fastener guide 305 may open simultaneously or at generally the same time.

Figure 6D:
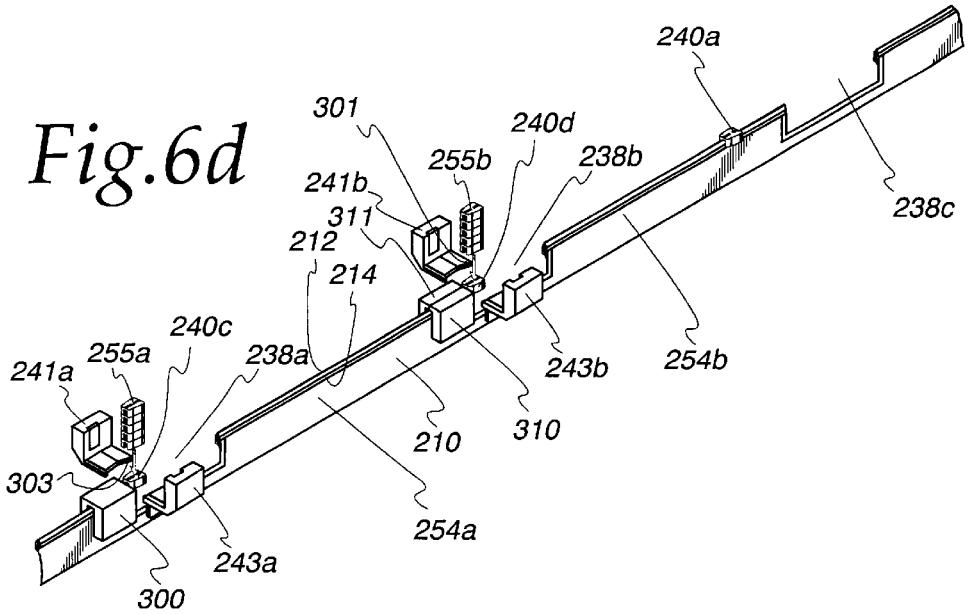

Through the process detailed above and as shown in FIGS. 5 and 6*a*–6*d*, the first slider 240*a* is applied onto the second segment 254*b* of the tracks 212, 214 and the second slider 240*b* is applied onto the third segment 254*c* of the tracks 212, 214. FIG. 6*d* shows the beginning of the successive dwell phase of the cycle, where the first slider inserter unit 255*a* feeds the successive slider 240*c* into the notch 238*a* and the second slider inserter unit 255*b* feeds the successive slider 240*b* into the notch 238*b* at generally the same time while the fastener 210 is temporarily stopped.

After applying the first and second sliders 240*a*, 240*b* onto the second and third segments 254*b*, 254*c* of the fastener 210, respectively, the double index of the fastener 210 is completed such that notches 238*c*, 238*d* become positioned at an end stop applicator station similar to the one described with respect to FIG. 1. In the embodiment shown in FIG. 5, notch 238*c* becomes positioned between a first pair of chilled, reciprocating molds 247*a*, 249*a* and is labeled notch 238*e*. The second segment 254*b* which contains slider 240*a* (labeled 24*e*) becomes positioned upstream from the first pair of chilled, reciprocating molds 247*a*, 249*a* and notch 238*e* and is labeled 254*d*. Also as shown in FIG. 5, notch 238*d* becomes positioned between a second pair of chilled, reciprocating molds 247*b*, 249*b* and is labeled notch 238*f*. The third segment 254*c* which contains slider 240*b* (labeled 240*f*) becomes positioned upstream from the second pair of chilled, reciprocating molds 247*b*, 249*b* and notch 238*f* and is labeled 254*e*. Also upon completing the double index, notch 238*a* becomes positioned below the first slider inserter unit 255*a* (see notch labeled 238*c* in FIG. 5) and notch 238*b* becomes positioned below the second slider inserter unit 255*b* (see notch labeled 238*d* in FIG. 5) such that the next two sliders 240*c*, 240*d* which are resting in the first and second slider inserter units 255*a*, 255*b*, respectively, are ready to be fed into notches 238*c*, 238*d*, respectively. At the end stop applicator station, the end stop applicator applies end stops 242*a*, 244*a* and 242*b*, 244*b* to the respective fastener ends 246*a*, 248*a* and 246*b*, 248*b* on opposite sides of the respective notches 238*e*, 238*f* In the plastic bags ultimately formed by the manufacturing process, end stop 242*a*is located at the fastener end 246*a* of one bag, end stop 244*a* is located at the fastener end 248*a* of the adjacent bag, while end stop 242*b* is located at the fastener end 246*b* of one bag and end stop 244*b* is located at the fastener end 248*b* of the adjacent bag. The end stop applicator station may include a first pair of chilled, reciprocating molds 247*a*, 249*a* and a second pair of chilled, reciprocating molds 247*b*, 249*b* which operate similar to those shown in FIG. 1 and described above. Also as described above with respect to FIG. 1, end stops other than injection-molded end stops may be applied to the fastener ends 246*a*, 246*b*, 248*a*, 248*b*.

While the fastener 210 is temporarily stopped during the dwell phase of the cycle in the method depicted in FIGS. 5 and 6*a*–6*d*, the various stations perform their respective functions on different parts of the continuous fastener 210 spaced apart at approximately at a double index (i.e., approximately two bag-width distances apart) either simultaneously or at generally the same time. Therefore, as (1) the preseal station forms new preseals 228, 229; (2) the notching station forms new notches 238*a*, 238*b* within the previously formed preseals 228, 229; (3) the slider insertion station applies sliders 240*a*, 240*b* into the notches 238*c*, 238*d*; and (4) the end stop applicator applies end stops 242*a*, 244*a* and 242*b*, 244*b* proximate the previously applied sliders at approximately the same time. Dwell is accomplished as described above with respect to FIG. 1. After each station has completed its respective function on the temporarily stopped fastener 210, movement of the fastener 210 is resumed. The fastener 210 is moved approximately two bag-width distances forward so that the next station can perform its respective function as described above with respect to FIG. 1.

While the process described above is directed to a process of forming two preseals, forming two notches within the preseals, applying two sliders into the previously formed notches, and applying two end stops proximate the previously applied sliders by having the various stations perform their respective functions on different parts of the continuous fastener 210 spaced approximately at a double index either simultaneously or at generally the same time, it is contemplated that the process may be modified. For example, the process may could be modified by having the various stations perform their respective functions on different parts of the continuous fastener 210 spaced approximately at a triple index, a quadruple index, etc. either simultaneously or at generally the same time. In other words, the process could be modified to form three or more preseals, to form three or more notches within the preseals, to apply three or more sliders into the previously formed notches, and to apply three or more end stops proximate the previously applied sliders by having the various stations perform their respective functions on different parts of the continuous fastener 210 spaced approximately at a triple index, a quadruple index, etc. either simultaneously or at generally the same time. After applying the end stops 242*a*, 244*a* and 242*b*, 244*b* using the method as described above, the fastener 210 is preferably applied to a flat web of plastic film that is then formed, filled with product, and made into individual plastic bags as described with respect to FIG. 1. Alternatively, as described above, the fastener 210 may be conveyed to a storage medium, and placed in an intermediate storage facility, and then applied to the plastic film at a later time. Finished bags may be produced by applying or attaching the slider-operated fastener to a flat web of plastic film and then conveying the web to a vertical FFS machine or a horizontal FFS machine as detailed above. FIG. 7 described above depicts one method for applying or attaching the slider-operated fastener 210 to a flat web of plastic film.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of applying at least two sliders onto a fastener comprising:

providing the fastener, the fastener including first and second opposing tracks, the first and second tracks including respective first and second interlocking profiles and respective first and second fins extending from the respective first and second profiles;

forming at least a first and a second opening into the tracks and the fins, the first opening is located downstream from the second opening, the first and second openings assist in defining a first segment and a second segment, the first segment is located upstream from and adjacent to the second opening, the second segment is located between the first opening and the second opening;

moving the second segment into a different plane from a plane of the first segment;

feeding a first slider into the first opening and a second slider into the second opening at generally the same time;

applying the first slider onto the second segment of the tracks and the second slider onto the first segment of the tracks at generally the same time as the fastener indexes forward.

2. The method of claim 1, wherein the moving step comprises bending the second segment into a horizontal plane wherein the angle between the first and second segments relative to one another is at least about 20°.

3. The method of claim 1, wherein the step of moving is accomplished using separate fingers while the fastener is temporarily stopped or being indexed forward.

4. The method of claim 1, wherein the step of forming the first opening and the second opening is accomplished with a reciprocating cutter or a rotary cutter.

5. The method of claim 1, wherein the first and second openings are slits or cuts in the tracks.

6. The method of claim 1, wherein the step of feeding occurs while the fastener is temporarily stopped.

7. The method of claim 1, wherein the step of applying is accomplished by threading.

8. The method of claim 1, wherein the step of applying the first slider onto the second segment of the tracks is accomplished with a first pair of grippers and the step of applying the second slider onto the first segment of the tracks is accomplished with a second pair of grippers.

9. The method of claim 1, further comprising the step of moving the second segment back into the plane of the first segment.

10. The method of claim 1, wherein the moving step comprises bending the first segment into a first plane and bending the second segment into a second plane, wherein the first and second planes are positioned at an angle relative to one another of at least about 20°.

11. The method of claim 10, wherein the first and second planes are positioned at an angle relative to one another of less than about 100°.

12. The method of claim 1, wherein the first and second openings are notches in the tracks.

13. The method of claim 12, wherein the notches are defined by a respective pair of opposing sides and a respective bottom bridging the opposing sides.

14. The method of claim 12, wherein the notches are generally U-shaped.

15. The method of claim 1, wherein the step of feeding is accomplished with a first slider inserter unit aligned with the first opening including at least one row of sliders and a second slider inserter unit aligned with the second opening including at least one row of sliders.

16. The method of claim 15, wherein the first and second slider inserter units are gravity feeders, power feeders, or mechanically driven feeders.

17. The method of claim 15, wherein the step of moving is accomplished by pivoting the second slider inserter unit into a different plane from the first slider inserter unit and using the second slider inserter unit to move the second segment into a different plane from the first segment.

18. The method of claim 1, further comprising the steps of releasing the second slider to travel with and remain on the first segment of the tracks and releasing the first slider to travel with and remain on the second segment of the tracks as the fastener indexes forward.

19. The method of claim 18, wherein the step of releasing the second slider to travel with and remain on the first segment of the tracks is accomplished with a first pair of grippers and the step of releasing the first slider to travel with and remain on the second segment of the tracks is accomplished with a second pair of grippers.

20. A method of applying at least two sliders onto a web of plastic film comprising:

providing a web of plastic film;

providing a fastener including first and second opposing tracks, the first and second tracks including respective first and second interlocking profiles and respective first and second fins extending from the respective first and second profiles;

forming at least a first and a second opening into the tracks and the fins, the first opening is located downstream from the second opening, the first and second openings assist in defining a first segment and a second segment, the first segment is located upstream from and adjacent to the second opening, the second segment is located between the first opening and the second opening;

moving the second segment into a different plane from a plane of the first segment;

feeding a first slider into the first opening and a second slider into the second opening at generally the same time;

applying the first slider onto the second segment of the tracks and the second slider onto the first segment of the tracks at generally the same time as the fastener indexes forward; and attaching the fastener to the web of plastic film.

21. The method of claim 20, wherein the step of feeding occurs while the fastener is temporarily stopped.

22. The method of claim 20, wherein the step of applying is accomplished by threading.

23. The method of claim 20, wherein the step of applying the first slider onto the second segment of the tracks is accomplished with a first pair of grippers and the step of applying the second slider onto the first segment of the tracks is accomplished with a second pair of grippers.

24. The method of claim 20, wherein the first and second openings are notches in the tracks.

25. The method of claim 20, wherein the moving step comprises bending the first segment into a first plane and bending the second segment into a second plane, wherein the first and second planes are positioned at an angle relative to one another of at least about 20°.

26. The method of claim 20, wherein the moving step comprises bending the second segment into a horizontal plane wherein the angle between the first and second segments relative to one another is at least about 20°.

27. The method of claim 20, wherein the step of moving is accomplished using separate fingers while the fastener is temporarily stopped or being indexed forward.

28. The method of claim 20, further comprising the step of moving the second segment back into the plane of the first segment.

29. The method of claim 20, further comprising the steps of releasing the second slider to travel with and remain on the first segment of the tracks and releasing the first slider to travel with and remain on the second segment of the tracks as the fastener indexes forward.

30. The method of claim 29, wherein the step of releasing the second slider to travel with and remain on the first segment of the tracks is accomplished with a first pair of grippers and the step of releasing the first slider to travel with and remain on the second segment of the tracks is accomplished with a second pair of grippers.

31. The method of claim 20, wherein the step of feeding is accomplished with a first slider inserter unit aligned with the first opening including at least one row of sliders and a second slider inserter unit aligned with the second opening including at least one row of sliders.

32. The method of claim 31, wherein the first and second slider inserter units are gravity feeders, power feeders, or mechanically driven feeders.

33. The method of claim 31, wherein the step of moving is accomplished by pivoting the second slider inserter unit into a different plane from the first slider inserter unit and using the second slider inserter unit to move the second segment into a different plane from the first segment.

34. A method of making reclosable plastic bags comprising:

providing a web of plastic film;

providing a fastener including first and second opposing tracks, the first and second tracks including respective first and second interlocking profiles and respective first and second fins extending from the respective first and second profiles;

sealing the first and second fins to each other;

forming at least a first and a second opening into the tracks and the fins, the first opening is located downstream from the second opening, the first and second openings assist in defining a first segment and a second segment, the first segment is located upstream from and adjacent to the second opening, the second segment is located between the first opening and the second opening;

moving the second segment into a different plane from a plane of the first segment;

feeding a first slider into the first opening and a second slider into the second opening at generally the same time;

applying the first slider onto the second segment of the tracks and the second slider onto the first segment of the tracks at generally the same time as the fastener indexes forward;

moving the second segment back into the plane of the first segment; conveying the fastener to an end stop applicator;

forming at least a first end stop on the first segment of the tracks and at least a second end stop on the second segment of the tracks;

attaching the fastener to the web of plastic film; and forming the web into a plurality of interconnected plastic bags.

35. The method of claim 34, further comprising the step of successively filling and sealing the plurality of interconnected plastic bags.

36. The method of claim 34, further comprising the steps of releasing the second slider to travel with and remain on the first segment of the tracks and releasing the first slider to travel with and remain on the second segment of the tracks as the fastener indexes forward.

37. The method of claim 36, wherein the step of releasing the second slider to travel with and remain on the first segment of the tracks is accomplished with a first pair of grippers and the step of releasing the first slider to travel with and remain on the second segment of the tracks is accomplished with a second pair of grippers.

* * * * *

UNITED STATES PATENT AND TRADEMARK OFFICE

CERTIFICATE OF CORRECTION

PATENT NO. : 6,780,146 B2
DATED : August 24, 2004
INVENTOR(S) : Toby R. Thomas et al.

It is certified that error appears in the above-identified patent and that said Letters Patent is hereby corrected as shown below:

Title page,
Item [56], References Cited, U.S. PATENT DOCUMENTS, please delete "4,820,178 A 4/1989 Anderson et al." and insert -- 4,850,178 07/1989 Ausnit --.

Signed and Sealed this

Fourth Day of January, 2005

JON W. DUDAS
*Director of the United States Patent and Trademark Office*